US008820875B2

(12) United States Patent
Fujii et al.

(10) Patent No.: US 8,820,875 B2
(45) Date of Patent: Sep. 2, 2014

(54) IMAGE FORMING METHOD AND INKJET RECORDING DEVICE USING THE SAME

(75) Inventors: Hidetoshi Fujii, Kanagawa (JP); Hiroshi Gotou, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 13/606,075

(22) Filed: Sep. 7, 2012

(65) Prior Publication Data

US 2013/0070017 A1 Mar. 21, 2013

(30) Foreign Application Priority Data

Sep. 15, 2011 (JP) ..... 2011-201278
Sep. 3, 2012 (JP) ..... 2012-193441

(51) Int. Cl.

*B41J 13/26* (2006.01)
*B41J 2/14* (2006.01)
*B41M 5/00* (2006.01)
*B41J 11/00* (2006.01)

(52) U.S. Cl.

CPC ..... *B41J 2/14274* (2013.01); *B41M 5/0011* (2013.01); *B41J 11/0015* (2013.01); *B41J 2002/14403* (2013.01)
USPC ..... 347/16

(58) Field of Classification Search

USPC ..... 347/14–16, 43, 98
See application file for complete search history.

(56) References Cited

U.S. PATENT DOCUMENTS 6,439,708 B1 8/2002 Kato et al.
2007/0197685 A1 8/2007 Aruga et al.
2008/0233363 A1 9/2008 Goto
2009/0043028 A1 2/2009 Matsuyama et al.
2009/0073211 A1 3/2009 Imoto
2009/0098312 A1 4/2009 Goto et al.
2009/0176070 A1 7/2009 Goto et al.
2010/0196601 A1 8/2010 Goto et al.
2010/0196602 A1 8/2010 Koyano et al.
2010/0295891 A1 11/2010 Goto et al.
2011/0057981 A1 3/2011 Aruga et al.
2011/0063362 A1* 3/2011 Takaori et al. ..... 347/21
2011/0164086 A1 7/2011 Ggoto et al.
2011/0199416 A1* 8/2011 Takahashi et al. ..... 347/16
2011/0310166 A1 12/2011 Namba et al.
2012/0098883 A1 4/2012 Matsuyama et al.
2012/0207983 A1 8/2012 Matsuyama et al.

FOREIGN PATENT DOCUMENTS

CN 1933978 3/2007
CN 102020886 4/2011
JP 6-239013 8/1994

(Continued)

OTHER PUBLICATIONS

U.S. Appl. No. 13/494,222, filed Jun. 12, 2012, Hidefumi Nagashima, et al.

(Continued)

*Primary Examiner* — Lamson Nguyen

(74) *Attorney, Agent, or Firm* — Oblon, Spivak, McClelland, Maier & Neustadt, L.L.P.

(57) ABSTRACT

An image forming method including applying a processing fluid for inkjet recording to both sides of a recording medium and, after applying the processing fluid, discharging ink onto at least one side of the recording medium to form an image thereon. The processing fluid for inkjet recording comprises water and a hydrosoluble organic solvent.

12 Claims, 11 Drawing Sheets

(56) References Cited

FOREIGN PATENT DOCUMENTS

| | | |
|---|---|---|
| JP | 11-002973 | 1/1999 |
| JP | 2001-199151 | 7/2001 |
| JP | 2001-334642 | 12/2001 |
| JP | 2004-155868 | 6/2004 |
| JP | 2005-297549 | 10/2005 |
| JP | 2007-276387 | 10/2007 |
| JP | 2007-307763 | 11/2007 |
| JP | 2009-166387 | 7/2009 |
| JP | 4487475 | 4/2010 |
| JP | 2010-120185 A | 6/2010 |
| JP | 2010-184481 | 8/2010 |
| WO | WO00/06390 | 2/2000 |

OTHER PUBLICATIONS

Chinese Office Action issued on Apr. 30, 2014 in Chinese patent application No. 201210337073.0.

* cited by examiner

IMAGE FORMING METHOD AND INKJET RECORDING DEVICE USING THE SAME

BACKGROUND OF THE INVENTION

This patent application is based on and claims priority pursuant to 35 U.S.C. §119 to Japanese Patent Application Nos. 2011-201278 and 2012-193441, filed on Sep. 15, 2011 and Sep. 3, 2012, respectively, the entire disclosures of which are hereby incorporated by reference herein.

1. Field of the Invention

The present invention relates to an image forming method and an inkjet recording device executing the image forming method.

2. Description of the Background Art

The inkjet recording method has been widely and rapidly diffused and used in recent years because it can form color images on plain paper with low running costs.

However, this method also causes image deficiencies such as ink blurring (hereinafter referred to as feathering) which causes significant deterioration of image quality depending on the particular combination of ink and recording media involved.

Therefore, minimizing the penetration of ink has been attempted in an effort to reduce the occurrence of feathering. However, this approach has problems in that the drying property of the ink deteriorates, which dirties the hands and smudges the image.

In addition, recording color images by the inkjet recording method invites other problems. For example, since images printed with ink having different colors are superimposed one on top of another, the colors blur and mingle at the color border areas (hereinafter referred to as color bleeding), which significantly degrades the image quality.

Therefore, the penetrating property of the ink has been improved in an attempt to solve the color bleeding problem. However, since the coloring agent penetrates deep the recording media, image density decreases and the amount of ink that penetrates to the reverse side of the recording medium increases, thereby preventing proper image printing in the duplex printing.

To solve both these problems at the same time, image forming methods using processing fluid and ink are proposed to improve the image quality.

For example, Japanese Patent Application Publication No. 2001-199151 (JP-2001-199151-A) describes a method of forming colored portions on recording media using a liquid composition in which particulates having a surface charged with a polarity reversed to that of aqueous ink are dispersed; WO 00/06390 describes a method of forming images by attaching an ink component and a first liquid containing polymer particulates to a recording medium to improve abrasion resistance of image formed materials; JP-2007-276387-A describes a method of improving the image density and anti-smear fixing property by a combination of a cation polymer and an organic acid; and JP-2004-155868-A describes a method of improving the image density by applying processing fluid having a high viscosity that contains cation polymers.

In addition, since the printing speed of inkjet devices has drastically increased in recent years, the drying property of ink on the recording media, curling, and cockling have become large issues.

To solve these, for example, Japanese Patent No. 4487475 (JP-4487475-B) describes a method of providing a process of correcting warping of a recording medium by applying heat or pressure thereto; JP-2005-297549-A describes a method of increasing the content of an aqueous organic solvent having an excellent moisture-retention property; JP-H06-239013-A describes a method of drying ink immediately after ink printing; and JP-H11-002973-A describes a method of increasing the rigidity of a recording medium by applying processing fluid containing a material having a cross-linking property to the recording medium.

Curling, in particular backward curling (a state in which the image-formed surface warps to the reverse side of the image formed side) is a major problem because it causes jamming when reversing a cut sheet (recording medium) in duplex printing.

As measures to take to solve this problem, JP-2010-184481-A describes a method of heating both sides of a recording medium separately; and JP-2007-307763-A describes a method of reducing curling based on image data.

However, these known technologies in a broad sense disclose no particular or specific composition of processing fluid particularly suitable to print images on plain paper having no coated layer with pigment ink. In addition, these technologies consume a large amount of power consumption and cannot solve the curling issue satisfactorily.

SUMMARY OF THE INVENTION

In view of the foregoing, the present invention provides an image forming method including an image forming method including applying a processing fluid for inkjet recording to both sides of a recording medium and after applying the processing fluid, discharging ink onto at least one side of the recording medium to form an image thereon, wherein the processing fluid for inkjet recording comprises water and a hydrosoluble organic solvent.

As another aspect of the present invention, an inkjet recording device is provided which includes an inkjet recording device configured to apply a processing fluid for inkjet recording to both sides of a recording medium; and after applying the processing fluid, discharge ink onto at least one side of the recording medium to form an image thereon, wherein the processing fluid for inkjet recording comprises water and a hydrosoluble organic solvent.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

The present disclosure is described in detail with reference to preferable embodiments.

Image Forming Method and Image Forming Apparatus

A device that forms images after applying processing fluid to both sides (surfaces) of a recording medium is described with reference to FIG. 1.

Figure 1:
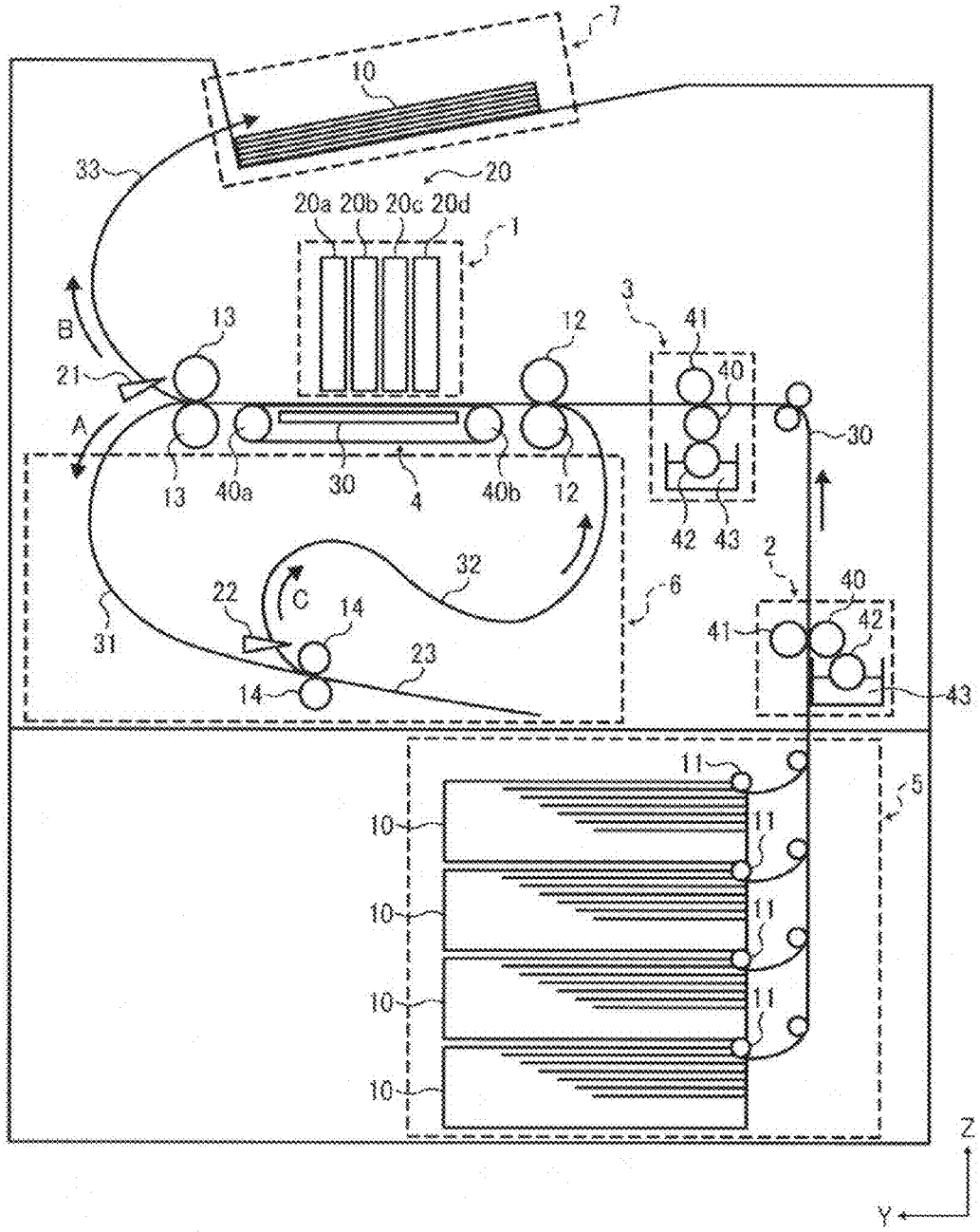
FIG. 1 is a schematic diagram illustrating an example of an ink jet recording device of the present disclosure.

FIG. 1 is a diagram illustrating the configuration of the ink jet recording device of an Embodiment of the present disclosure.

The inkjet recording device in this Embodiment includes an inkjet recording unit 1, a first processing fluid applicator 2, a second processing fluid applicator 3, an inkjet printing transfer unit 4, a sheet feeder 5, and a sheet re-feeder 6 and forms images by scanning at once by aligned inkjet recording heads.

In the inkjet recording device of FIG. 1, a recording medium 10 is sent from a sheet feeder 5 by a sheet feeding roller 11; processing fluid is uniformly applied to the surface of the recording medium 10 on which an image is secondarily formed by an application roller 40 and a counter roller 41 at the first processing fluid applicator 2; and after the recording medium 10 passes through a transfer route 30, the processing fluid is uniformly applied to the surface of the recording medium 10 on which an image is firstly formed by the application roller 40 and the counter roller 41 at the second processing fluid applicator 3.

The first processing fluid applicator 2 and the second processing fluid applicator 3 have a mechanism in which the processing fluid is drawn by a drawing roller 42 from a processing fluid tank 43 to be uniformly applied to the application roller 40. The time between when the processing fluid is applied at the first processing fluid applicator 2 and when the processing fluid is applied at the second processing fluid applicator 3 is controlled by the transfer speed. The recording medium 10 to which the processing fluid is applied is transferred to the inkjet recording unit 1.

The inkjet recording unit 1 is configured by multiple recording heads in which the nozzles are arranged to have a particular resolution in the sub-scanning direction by the kind of ink. A recording head 20 records an ink image on the recording medium 10 transferred to the recording position by a transfer roller 12.

The recording head 20 includes fine ink discharging mouths, a liquid path, and a device provided to part of the liquid path which discharges droplets by the pressure of a piezoelectric element that elongates and contracts due to an applied voltage. The recording head is deferred in detail.

Ink transfer pipes are linked with each ink tank which accommodates ink of one of yellow, magenta, cyan, and black to discharge (spray) ink of color of yellow, magenta, cyan, and black. Under the recording head 20, there is provided an ink retainer that collects waste ink produced during head cleaning and is linked with a waste ink tank.

The ink retained in the ink retainer is collected in the waste ink tank by an ink collecting pump.

Under the recording head 20, the inkjet printing transfer unit 4 is provided between the transfer roller 12 and a discharging roller 13.

The inkjet printing transfer unit 4 has an endless form belt which serves as transfer member of the recording medium 10 and is suspended over multiple rollers formed of a driving roller 26*a* and a driven roller 26*b*.

The inkjet printing transfer unit 4 is configured to transfer the recording medium 10 fed from the sheet feeder 5 to the discharging roller while attracting the recording medium 10 to the endless form belt by driving the driving roller 26*a* and an extract fan.

The discharging roller discharges the recording medium 10, on which the ink image is recorded, from the recording position.

A flapper 12 is a member to switch the discharging route of the recording medium 10 suitably depending on the simplex or duplex mode.

The sheet re-feeder 6 is a transfer unit to supply the recording medium 10 on which the ink image is recorded on one side to the re-recording position in the duplex mode.

A proper-reversing roller 14 changes the transfer direction of the recording medium 10. The flapper 21 switches the transfer direction of the recording medium 10 discharged from the recording position to a transfer route 31 to supply it back to the recording position again. The recording medium 10, on which the ink image is recorded, is stacked in a discharging unit 7.

The recording medium 10 on which the ink image is recorded is guided to the flapper 21 by the discharging roller 13.

In the case of the duplex mode, the flapper 21 guides the recording medium 10 into the direction indicated by an arrow A in FIG. 1 and sends it to the sheet re-feeder 6 via the transfer route 31. The recording medium 10 that has been fed to the sheet re-feeder 6 is sent to a reversing pocket 23 by the proper reversing roller 14.

When the recording medium 10 is sent in the reversing pocket 23, a flapper 22 switches the transfer direction of the recording medium 10 to send it in the direction indicated by an arrow C in FIG. 1.

After the transfer direction is changed, the proper reversing roller 14 reversely rotates relative to the rotation direction thereof when sending the recording medium 10 into the reversing pocket 23 and discharges the recording medium 10 from the reversing pocket 23.

The recording medium 10 discharged from the reversing pocket 23 is guided to the transfer roller 12 via an S-shape transfer route 32 and transferred again to the recording position on the inkjet printing transfer unit 4 by the transfer roller 12.

The recording head 20 records another ink image on the reverse side of the recording medium 10 transferred back again to the recording position to the side on which the ink image has been already printed.

The recording medium 10 on which the ink images are recorded on both sides is guided to the flapper 21 by the discharging roller 13.

After recording the ink images on both sides of the recording medium 10, the flapper 21 guides the recording medium 10 to the direction indicated by an arrow B in FIG. 1 and transfers the recording medium 10 upward along a transfer route 33 to discharge it into the discharging unit 7, where the recording medium 10 is stacked.

In the case of the simplex mode, after recording an ink image on one side of the recording medium 10, the flapper 21 guides the recording medium 10 to the direction indicated by the arrow B to transfer it upward along the transfer route 33 and discharge it immediately into the discharging unit 7, where the recording medium 10 is stacked.

With such a configuration, images are formed by the inkjet recording head 20 in the state in which the liquid application is applied to both sides of the recording medium 10.

Therefore, since the moisture difference between the top side and the bottom side of the recording medium 10 is lessened, curling of the recording medium 10 that occurs when forming an image can be reduced.

Furthermore, by applying the processing fluid to the side of the recording medium 10 on which an image is formed first to cause the difference in the amount of the processing fluid between the top side and the bottom side of the recording medium 10, the recording medium 10 curls, which prevents backward curling of the recording medium when forming an image on the side on which the image is formed first.

Figure 2:
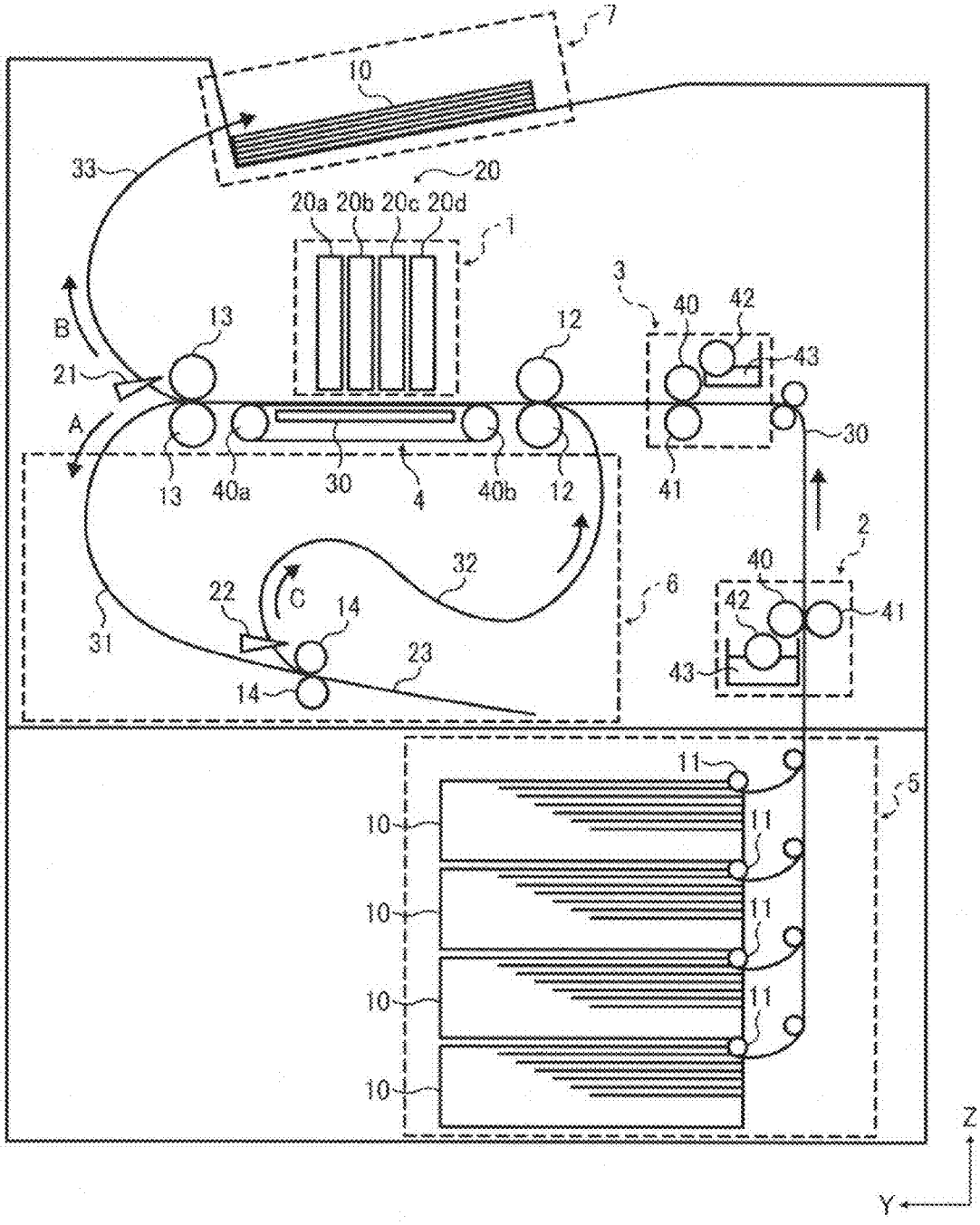
FIG. 2 is a schematic diagram illustrating another example of an ink jet recording device of the present disclosure.

FIG. 2 is a diagram illustrating another example of the configuration of the inkjet recording apparatus of another embodiment.

The difference between this example and that of FIG. 1 is that, after applying the processing fluid to the side on which an image is formed first at the first processing fluid applicator 2, the second processing fluid applicator 3 applies the processing fluid to the side on which an image is secondarily formed.

In this configuration, the recording medium 10 is sent from the sheet feeder 5 by the sheet feeding roller 11; the processing fluid is uniformly applied to the side of the recording medium 10 on which an image is firstly formed by the application roller 40 and the counter roller 41 at the first processing fluid applicator 2; and after the recording medium 10 passes through the transfer route 30, the processing fluid is uniformly applied to the surface of the recording medium 10 on which an image is formed secondarily by the application roller 40 and the counter roller 41 at the second processing fluid applicator 3.

The recording medium 10 to which the processing fluid is applied is transferred to the inkjet recording unit 1.

The inkjet recording device illustrated in FIG. 2 is the same as that illustrated in FIG. 1 except for the process of from feeding the recording medium 10 to transferring the recording medium 10 to the inkjet recording unit 1.

With such a configuration, images are formed by the inkjet recording head 20 in the state in which the liquid application is applied to both sides of the recording medium 10 in the same manner as in FIG. 1.

Therefore, since the moisture difference between the top side and the bottom side of the recording medium 10 is lessened, curling of the recording medium 10 that occurs when forming an image can be reduced.

Figure 3:
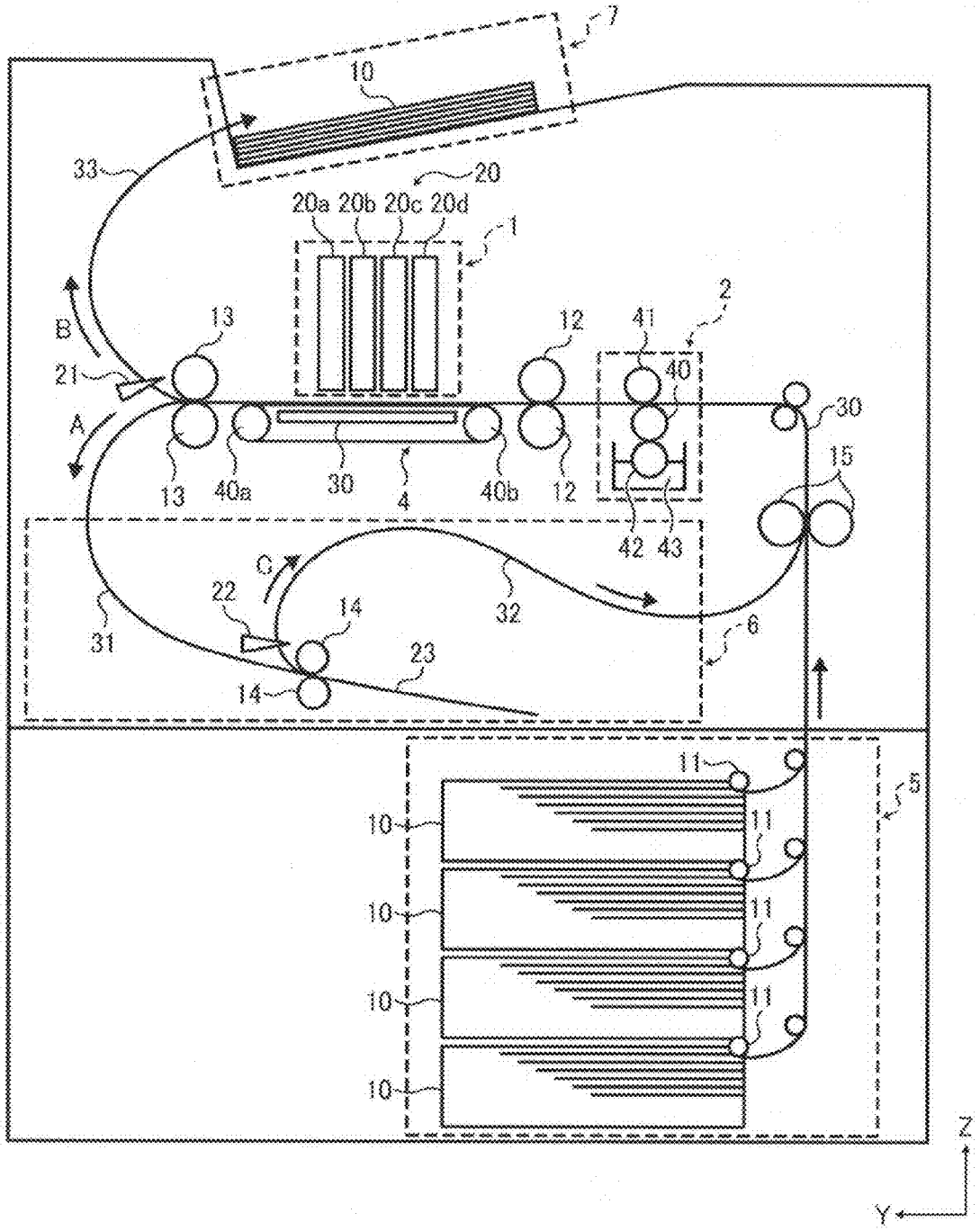
FIG. 3 is a schematic diagram illustrating another example of an ink jet recording device of the present disclosure.

FIG. 3 is a diagram illustrating another example of the configuration of the inkjet recording device of another embodiment.

The difference between the devices illustrated in FIGS. 1 and 2 is that only the first processing fluid applicator 2 is provided without the second processing fluid applicator 3 and the route of the sheet re-feeder 6 is linked between the first processing fluid applicator 2 and the sheet feeder 5.

In this configuration, the recording medium 10 is sent from the sheet feeder 5 by the sheet feeding roller 11; the processing fluid is uniformly applied to the surface of the recording medium 10 on which an image is firstly formed by the application roller 40 and the counter roller 41 at the first processing fluid applicator 2; and the recording medium 10 passes through the inkjet printing transfer unit 4 and is guided to the sheet re-feeder 6 by the discharging roller 13 and the flapper 21.

The recording medium 10 that has been fed to the sheet re-feeder 6 is sent to the reversing pocket 23 by the proper reversing roller 14.

When the recording medium 10 is sent in the reversing pocket 23, the flapper 22 switches the transfer direction to send the recording medium 10 in the direction indicated by the arrow C in FIG. 3.

After the transfer route is changed, the proper reversing roller 14 reversely rotates relative to the rotation direction thereof when sending the recording medium 10 into the reversing pocket 23 and discharges the recording medium 10 from the reversing pocket 23.

The recording medium 10 discharged from the reversing pocket 23 is guided to a transfer roller 15 via the S-shape transfer route 32. The processing fluid is uniformly applied again to the surface of the recording medium 10 on which an image is secondarily formed by the application roller 40 and the counter roller 41 at the first processing fluid applicator 2.

Thereafter the recording medium 10 is transferred to the inkjet recording unit 1 and an ink image is formed by the recording head 20.

The recording medium 10 is guided to the flapper 21 by the discharging roller 13. In the case of the simplex mode, an ink image is recorded on one side of the recording medium 10 and thereafter the flapper 21 guides the recording medium 10 to the direction indicated by the arrow B in FIG. 3 to transfer it upward along the transfer route 33 and discharge it immediately into the discharging unit 7, where the recording medium 10 is sequentially stacked.

In the case of the duplex mode, the flapper 21 guides the recording medium 10 in the direction indicated by the arrow A in FIG. 3 and sends it to the sheet re-feeder 6 via the transfer route 31.

The recording medium 10 that has been fed to the sheet re-feeder 6 is sent to the reversing pocket 23 by the proper reversing roller 14.

When the recording medium 10 is sent in the reversing pocket 23, the flapper 22 switches the transfer route to send the recording medium 10 in the direction indicated by the arrow C in FIG. 3. After the transfer route is changed, the proper reversing roller 14 reversely rotates relative to the rotation direction thereof when sending the recording medium 10 into the reversing pocket 23 and discharges the recording medium 10 from the reversing pocket 23.

The recording medium 10 that has been discharged from the reversing pocket 23 is guided to the transfer roller 15 via an S-shape transfer route 32.

After the recording medium 10 is sent from the transfer roller 15 to the first processing fluid applicator 2, the processing fluid is uniformly applied to the surface of the recording medium 10 on which an image is firstly formed by the application roller 40 and the counter roller 41 at the first processing fluid applicator 2.

Thereafter, the recording medium 10 is transferred to the inkjet recording unit 1 and an ink image is formed on the other side of the recording medium by the recording head 20.

At this point in time, if a mechanism is provided which releases the pressure between the application roller and the counter roller of the processing fluid applicator or a mechanism is provided which separates the application roller from the drawing roller, it is possible to prevent the re-application of the processing fluid to the surface on which the image is firstly formed.

The recording medium 10 on which the ink images are recorded on both sides is guided to the flapper 21 by the discharging roller 13.

After recording the ink images on both sides of the recording medium 10, the flapper 21 guides the recording medium 10 to the direction indicated by the arrow B in FIG. 3 and transfers the recording medium 10 upward along the transfer route 33 to discharge it into the discharging unit 7, where the recording medium 10 is sequentially stacked.

Figure 4:
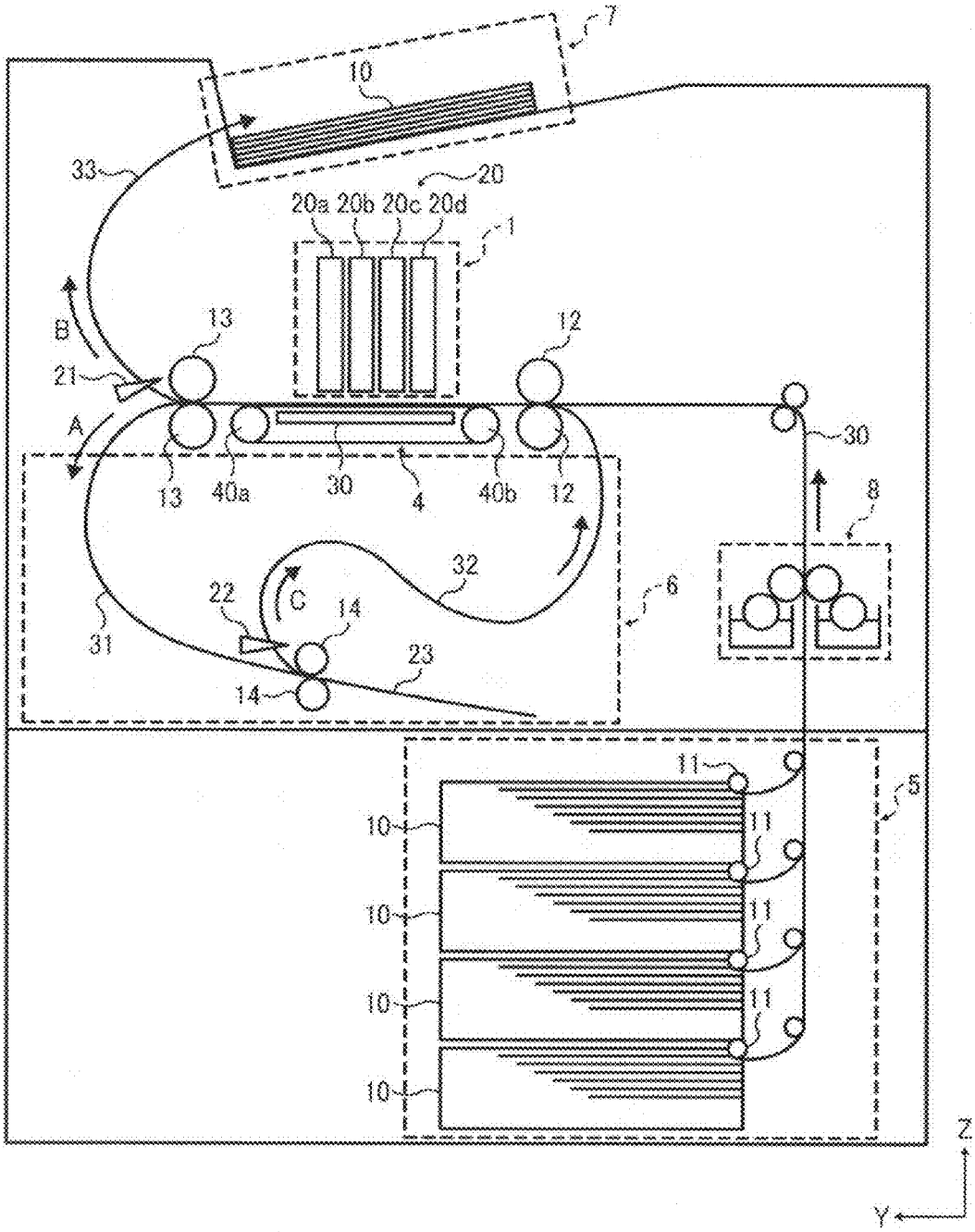
FIG. 4 is a schematic diagram illustrating another example of an ink jet recording device of the present disclosure.

FIG. 4 is a diagram illustrating another example of the configuration of the inkjet recording apparatus of another embodiment.

The difference between the devices illustrated in FIGS. 1 and 2 is that both the first processing fluid applicator 2 and the second processing fluid applicator 3 are not provided but instead a both side processing fluid applicator 8 is provided.

In this configuration, the recording medium 10 is sent out from the sheet feeder 5 by the discharging roller 11 and the both side processing fluid applicator 8 applies the processing fluid to both sides of the recording medium 10. Thereafter, the recording medium is transferred to the ink jet recording unit 1 and an ink image is formed by the recording head 20.

The inkjet recording device illustrated in FIG. 4 is the same as that illustrated in FIG. 1 except for application of the processing fluid to both sides of the recording medium at the same time in the process of from feeding the recording medium 10 to transferring the recording medium 10 to the inkjet recording head 1.

With such a configuration, the configuration is made simple and since the respective application rollers serve as the counter rollers to the application rollers on the other side relative to the recording medium 10, thereby reducing the number of the parts and saving the foot space.

As apparent from the transfer process of the recording medium of this device, after applying the processing fluid to the recording medium, it is necessary to transfer the recording medium to which the processing fluid is applied by a device such as a roller and a guide that contacts the recording medium in most cases.

If the processing fluid imparted to the recording medium is transferred to the transfer device for the recording medium, problems arise such that the transfer feature is damaged and contamination accumulates, thereby degrading the image quality.

To prevent occurrence of such problems, it is possible to reduce the impact of such problems by taking measures of, for example, using a corrugated plate as the guide, a roller having a spur form, or a roller having a surface made of a water-repellent material.

However, it is preferable that the processing fluid imparted to the recording medium is absorbed as soon as possible to make the surface of the recording medium look thy.

To attain this objective, it is good to use a processing fluid having a surface tension of 40 mN/m or less in order for the processing fluid to penetrate into the recording medium soon. "Drying and solidification" after applying (imparting) the processing fluid to the recording medium does not mean that the recording medium looks dry as described above but the liquid compounds such as water in the processing fluid evaporate to the degree that the processing fluid cannot keep the liquid state and is solidified.

By using the recording device having both the processing fluid applicator applying a processing fluid in combination with an image forming device, inkjet recording can be conducted in the state in which the processing fluid is absorbed to the recording medium and looks dry but not solidified thereon and the image quality can be significantly improved with usage of even an extremely small amount of the processing fluid.

The operation of the device as illustrated in FIG. 1 is controlled by, for example, a home computer and when a print instruction therefrom is received, the recording device starts heating the heating roller, cleaning the head, and applying the processing fluid at the same time and when all is done, the recording images starts.

By processing the application of the processing fluid, head cleaning, checking ink discharging, data processing, and transfer of image data in parallel, images can be recorded without reducing the throughput of the print recording device even when the processing fluid is applied.

The inkjet recording device of this embodiment is suitable for cut sheets in particular because the cut sheet is a recording medium that tends to have problems of curling and cockling.

The cut sheets include in general the following: A3 size (297 mm×420 mm), A4 size (210 mm×297 mm), A5 size (148 mm×210 mm), A6 size (105 mm×148 mm), B4 size (257 mm×364 mm), B5 size (182 mm×257 mm), B6 size (128 mm×182 mm), Letter size (215.9 min×279.4 mm), and Legal size (215.9 mm×355.6 mm).

In the inkjet recording device of this embodiment, the processing fluid is applied to both sides of the recording medium before the ink is applied thereto by the inkjet recording device to reduce the difference in the moisture amount between the top side and the bottom side of the recording medium 10 when the ink is applied, thereby reducing the occurrence of jamming caused by curling.

Inkjet Recording Head

The inkjet recording head related to the present disclosure is suitable for on-demand recording.

Figure 5:
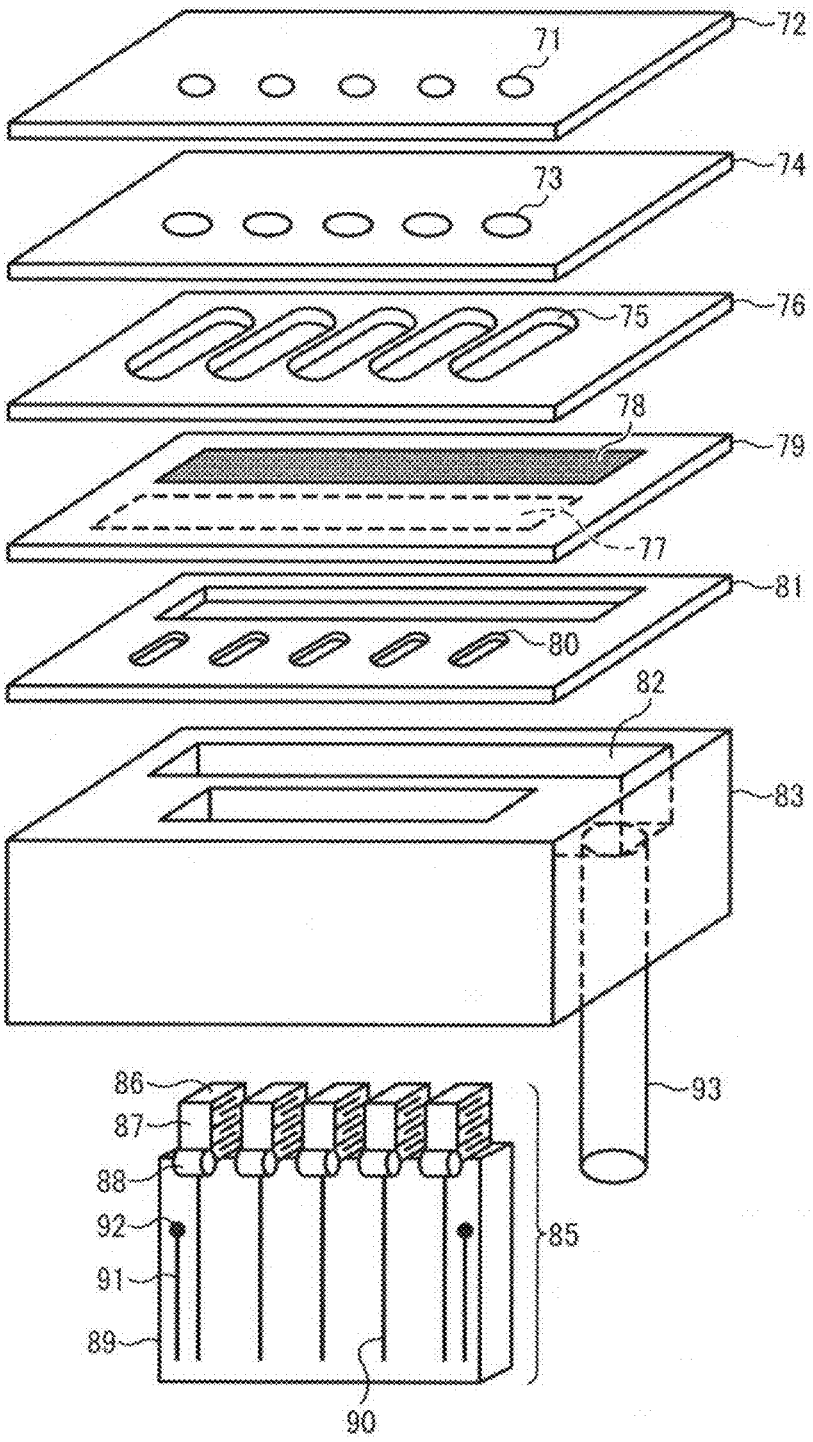
FIG. 5 is an explosive perspective view illustrating a recording head related to an embodiment of the present disclosure.
Figure 6:
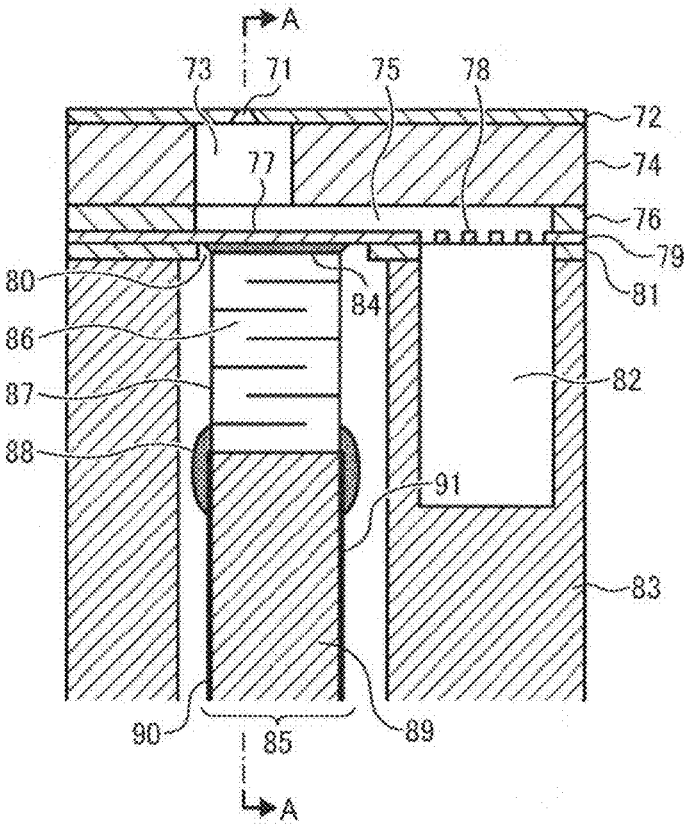
FIG. 6 is a cross-section illustrating the assembled recording head illustrated in FIG. 5.
Figure 7:
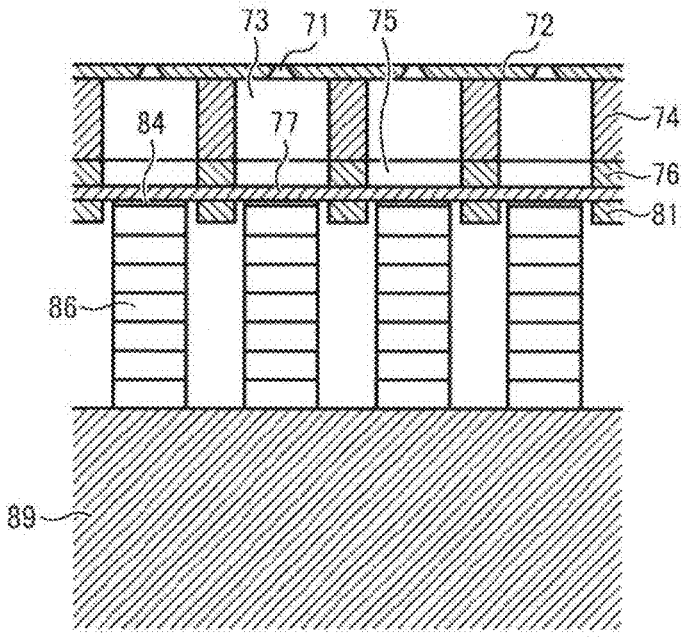
FIG. 7 is a cross-section on line A-A of FIG. 6.

FIGS. 5 to 7 are diagrams illustrating the details of the recording head. FIG. 5 is an explosive perspective view, FIG. 6 is a cross section of the assembled recording head portion, and FIG. 7 is a cross section relative to the line A-A of FIG. 6.

In these figures, 71 represents a nozzle, 72 represents a nozzle plate, 73 represents a pressure room, 74 represents a pressure room plate, 75 represents a restrictor, 76 represents a restrictor plate, 77 represents a diaphragm, 78 represents a filter, 79 represents a diaphragm plate, 80 represents a hole portion, 81 represents a support plate, 82 represents a shared liquid path, 83 represents a housing, 84 represents an adhesive, 85 represents a piezoelectric actuator, 86 represents a piezoelectric vibrator, 87 represents an external electrode, 88 represents an electroconductive adhesive, 89 represents a support substrate, 90 represents an individual electrode, 91 represents a shared electrode, 92 represents a through hole, and 93 represents a liquid induction tube.

As illustrated in FIG. 5, this on-demand type recording the head has the nozzle plate 72, the pressure room plate 74, the restrictor plate 76, the diaphragm plate 79, the support plate 81, the housing 83, and the piezoelectric actuator 85.

The nozzle plate 72 having multiple nozzles 71 in a line is manufactured by an electroforming processing method for nickel material and a precision press processing method or a laser method for stainless steel material, etc.

The pressure room 73 corresponding to the nozzle 71 is formed on the pressure room plate 74, which is in communication with the nozzle 71.

As illustrated in FIG. 5, the restrictor plate 76 is in communication with the shared liquid path 82 and the pressure room 73 and has the restrictor 75 to control the liquid flow amount to the pressure room 73.

The pressure room plate 74 and the restrictor plate 76 are manufactured by an etching method for stainless steel material, an electroforming processing method for nickel material, etc.

The diaphragm plate 79 has a diaphragm 77 to transmit the pressure of the piezoelectirc vibrator 86 efficiently to the pressure room 73 and the filter 78 to remove foreign objects in the liquid flowing from the shared liquid path 82 to the restrictor 75.

The diaphragm plate 79 is manufactured by an etching method for stainless steel material, an electroforming processing method for nickel material, etc.

The support plate 81 has the hole portion 80 to determine the position of the vibration fixing end of the diaphragm 77 and prevent an adhesive 84 that has run over from the adhesive portion from spreading on the diaphragm 77 when the diaphragm 77 and the piezoelectric vibrator 86 are fixed with the adhesive 84.

The support plate 81 is manufactured by an etching method for stainless steel material, an electroforming processing method for nickel material, etc.

The housing 83 made of metal or synthesis resins has the shared liquid path 82 and tubes are connected to the shared liquid path 82 to supply the ink thereto.

The ink passes through the filter 78 in the middle of the shared liquid path of the recording head and flows through from the restrictor 75, the pressure room 73, to the nozzle 71 in this sequence.

The piezoelectric vibrator 86 elongates and contracts upon application of a pulse voltage between the separate electrode 90 and the shared electrode 91 and returns to the state before elongation and contraction when the application of the pulse voltage is stopped.

Such transformation of the piezoelectric vibrator 86 transmit pressure instantly to the processing fluid in the pressure room 73 to discharge the ink from the nozzle as droplets, which land on the recording medium 10.

Any size of droplets can be discharged by selecting the magnitude and the kind of the applied pulse voltage.

Figure 8:
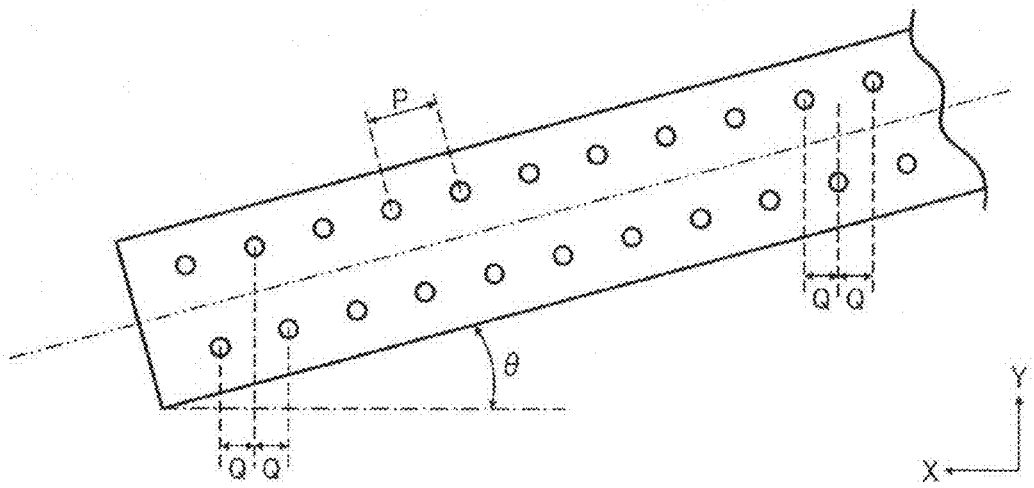
FIG. 8 is a relational diagram illustrating the nozzle of the recording head and a method of transferring recording medium
Figure 9:
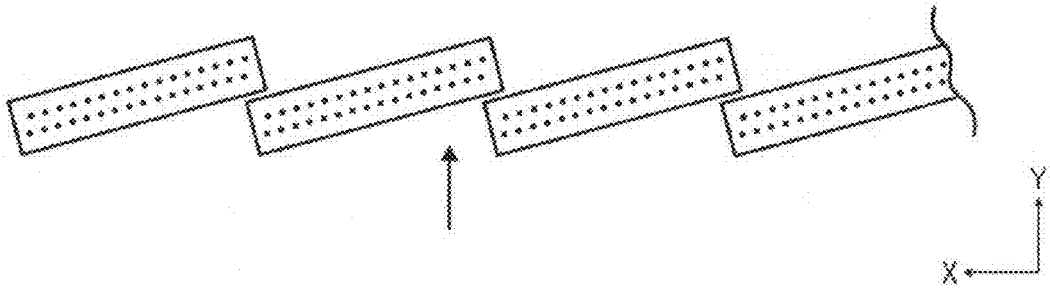
FIG. 9 is a view illustrating an example of a recording head arranged in lines.

FIG. 8 is a plain view illustrating the relationship between the position of the nozzles of the recording head and the transfer direction of the recording medium 10. FIG. 9 is a diagram illustrating the arrangement of the multiple recording heads arranged in line.

As illustrated in FIGS. 8 and 9, the nozzles 71 are formed with a pitch P on the recording head and a pitch Q in the sub-scanning direction of the transfer direction by tilting the recording head at an inclination angle θ.

As illustrated in FIGS. 8 and 9, by the arrangement of multiple recording heads having a small size, it is possible to form an image in any length range by scanning at once.

Process Liquid Applicator

Figure 10:
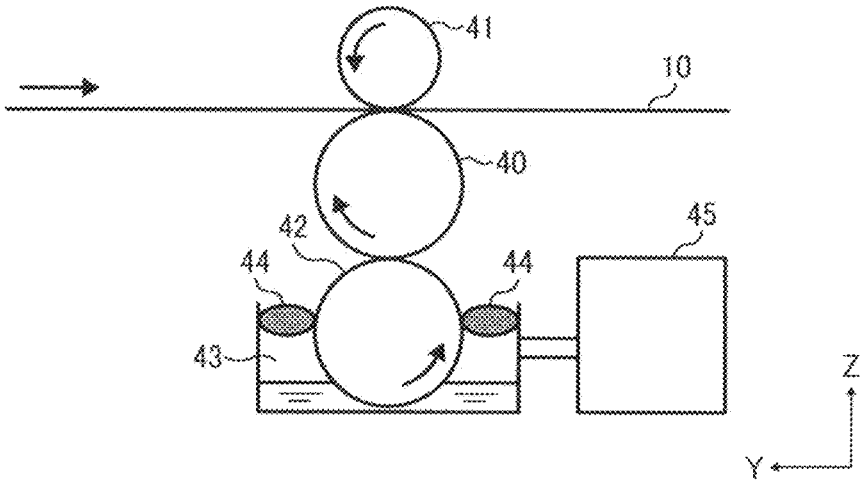
FIG. 10 is a schematic diagram illustrating an example of an applicator.
Figure 11:
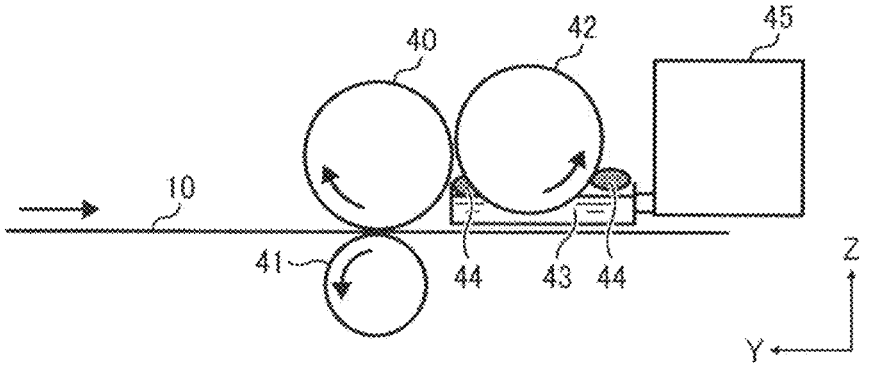
FIG. 11 is a schematic diagram illustrating another example of an applicator.
Figure 12:
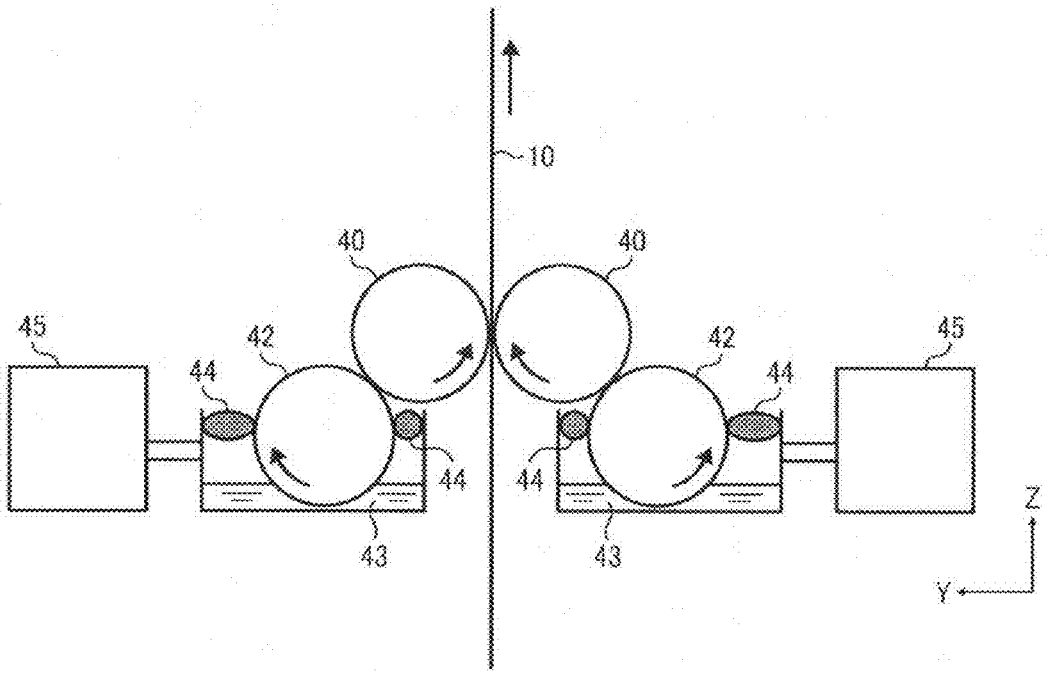
FIG. 12 is a schematic diagram illustrating another example of an applicator.
Figure 13:
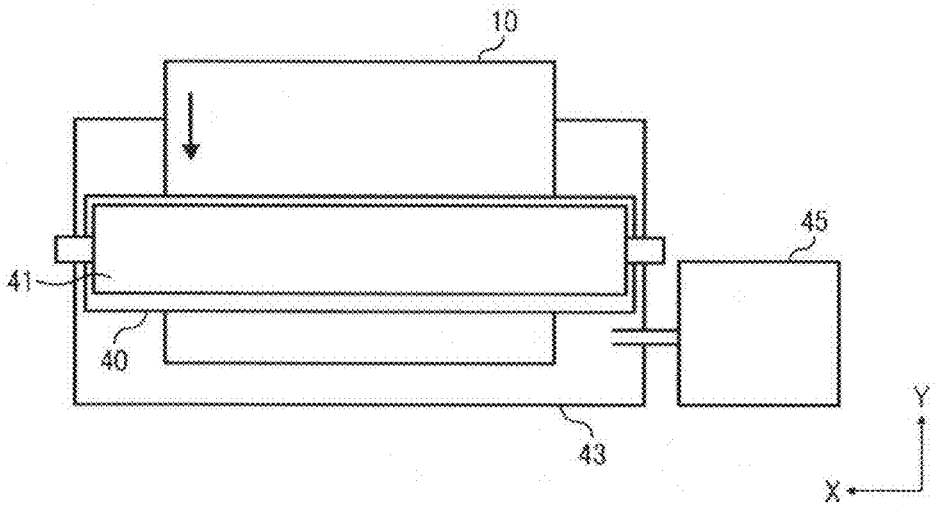
FIG. 13 is a plain view illustrating an example of an applicator.

FIGS. 10, 11, and 12 are schematic diagrams illustrating examples of the present disclosure and FIG. 13 is a plain view illustrating an example of the applicator.

As illustrated in FIGS. 10, 11, and 12, the processing fluid applicator has an application roller that bears the processing fluid, a counter roller that contacts the application roller and rotates in the direction reverse to that of the application roller, a drawing roller having a roller form with a part dipped in the processing fluid stored in a processing fluid container to draw up the processing fluid while stirring the processing fluid and bear the processing fluid on the surface of the drawing roller, and a processing fluid tank that stores a large amount of the processing fluid to supply the processing fluid to the processing fluid container.

In FIGS. 10 and 11, the processing fluid drawn up by the drawing roller is borne on the surface of the application roller. The application roller and the counter roller contact with each other with a uniform pressure so that the processing fluid is applied to the recording medium 10 on the side of the application roller with an even thickness.

In FIG. 12, since the two application rollers contact with an even pressure, the process is applied to the recording medium 10 on the side of the application roller with an even thickness.

An elastic member 44 such as rubber is provided between the processing fluid container and the drawing roller while contacting the drawing roller to prevent scattering of the processing fluid caused by the drawing roller, reduce evaporation of the processing fluid, and clean the drawing roller.

It is possible to control the amount of application of the processing fluid arbitrarily by controlling the material of the application roller and the counter roller and the pressure therebetween, the kind of the recording medium 10, the application speed, the viscosity of the processing fluid, and the penetrating property thereof.

It is also possible to make the processing fluid borne on the application roller uniform and control the amount of the processing fluid by providing a layer thickness controlling roller between the drawing roller and the application roller.

As illustrated in FIGS. 2 and 3, the processing fluid applicator possibly applies the processing fluid to the top side and the bottom side of the recording medium 10 even when the recording medium 10 is transferred vertically by adjusting the arrangement of the application roller, the counter roller, and the drawing roller.

Processing Process

Although the roller coating method is already described as the processing fluid application process of the present disclosure, there is no limitation to the method of applying the processing fluid to the surface of the recording medium and any method of applying the processing fluid uniformly can be suitably used.

Specific examples of such application methods include, but are not limited to, a blade coating method, a gravure coating method, a gravure offset coating method, a bar coating method, a roll coating method, a knife coating method, an air knife coating method, a comma coating method, a U comma coating method, an AKKU coating method, a smoothing coating method, a micro gravure coating method, a reverse roll coating method, a four or five roll coating method, a dip coating method, a curtain coating method, a slide coating method, and a die coating method.

It is preferable in particular to dip a rotating body in the processing fluid and contact the dipped rotating body with the recording medium 10 in terms that the processing fluid is uniformly applied.

The wet attachment amount of the processing fluid to the recording medium in the processing process preferably ranges from 0.1 $g/m^2$ to 30.0 $g/m^2$ and more preferably from 0.2 $g/m^2$ to 10.0 $g/m^2$.

When the attachment amount is too small, the image quality (such as image density, color saturation, color bleeding, text blurring, and white spots) tends to be improved little. When the attachment amount is too large, the texture as plain paper tends to be lost and curling and cockling tend to occur.

As another application method of the processing fluid, it is possible to apply the processing fluid to the entire of a recording medium in the same manner as the ink by the inkjet recording head. However, there are limitations to the viscosity, the surface tension, and the liquid contact property of the processing fluid to discharge and apply the processing fluid by the inkjet recording head.

In the case in which droplets discharged from the recording head are applied to the entire surface, the applied state is not uniform without increasing the definition of the discharged processing fluid extremely.

Processing Liquid (Liquid Dispersant)

The processing fluid of the present disclosure contains at least a hydrosoluble organic solvent and water.

Preferably, a hydrosoluble agglomerating agent and a surface active agent are added in suitable amounts.

Hydrosoluble Organic Solvent

Specific examples of the hydrosoluble organic solvent include, but are not limited to, polyols, polyol alkyl ethers, polyol aryl ethers, nitrogen-containing heterocyclic compounds, amides, amines, sulfur-containing compounds, propylene carbonates, and ethylene carbonate.

As the hydrosoluble organic solvent contained in the processing fluid, the content of the hydrosoluble organic solvent having a high equilibrium moisture is required to be small.

By reducing the content of the hydrosoluble organic solvent having a high equilibrium moisture content, the processing fluid and the ink dry soon on the recording medium.

In the present disclosure, the hydrosoluble organic solvent having a high equilibrium moisture content (hereinafter referred to as the hydrosoluble organic solvent A) represents a hydrosoluble organic solvent having an equilibrium moisture content of 30% by weight or more and preferably 40% by weight or more at 23° C. and 80% RH.

Since the hydrosoluble organic solvent A holds a large amount of water, the viscosity of the processing fluid does not increase much even when the moisture evaporates and reaches the equilibrium moisture while the processing fluid is left undone.

The equilibrium moisture content of the hydrosoluble organic solvent represents the amount of water therein obtained when a mixture of the hydrosoluble organic solvent and water are released into air at a constant temperature and humidity and the evaporation of the water in the solution and the absorption of the water in air in the solution are in an equilibrium condition.

To be specific, the equilibrium moisture content can be obtained as follows: while keeping the temperature and the humidity in a desiccator using a saturated potassium chloride solution in the range of from 22° C. to 24° C. and from 77% to 83%, respectively, a petri dish on which 1 g of each of hydrosoluble organic solvent is placed is preserved in the desiccator until no mass change is seen followed by calculation based on the following Relationship 1.

$$\text{Equilibrium moisture content (\%)}=\{\text{Moisture amount absorbed in organic solvent}/(\text{Content of organic solvent}+\text{Moisture amount absorbed in organic solvent})\}\times 100 \qquad \text{Relationship 1}$$

As the hydrosoluble organic solvent A suitably for use in the present disclosure, polyols having an equilibrium moisture content of 30% by weight or more in an environment of 23° C. and 80% RH are suitable.

Specific example of the hydrosoluble organic solvent A include, but are not limited to, 1,2,3-butane triol (boiling point: 175° C./33 hPa, equilibrium moisture content: 38% by weight), 1,2,4-butane triol (boiling point: 190° C. to 191° C./24 hPa, equilibrium moisture content: 41% by weight), glycerin (boiling point: 290° C., equilibrium moisture content: 49% by weight), diglycerin (boiling point: 270° C./20 hPa, equilibrium moisture content: 38% by weight), triethylene glycol (boiling point: 285° C., equilibrium moisture content: 39% by weight), tetraethylene glycol (boiling point: 324° C. to 330° C., equilibrium moisture content: 37% by weight), diethylne glycol (boiling point: 245° C., equilibrium moisture content: 43% by weight), and 1,3-butane diol (boiling point 203° C. to 204° C., equilibrium moisture content: 35% by weight).

The content of the hydrosoluble organic solvent A is suitably 5% by weight or less.

In the present disclosure, other than the hydrosoluble organic solvent A having a high equilibrium moisture content, it is suitable to use a hydrosoluble organic solvent (hereinafter referred to as the hydrosoluble organic solvent B) having a low equilibrium moisture content in combination.

By a combinational use of the hydrosoluble organic solvent A and the hydrosoluble organic solvent B, the processing fluid penetrates into the recording medium quickly.

Specific examples of the hydrosoluble organic solvent B include, but are not limited to, isobutyl diglycol (boiling point: 220° C., equilibrium moisture content: 10% by weight), tripropylene glycol monomethylether (boiling point: 242° C., equilibrium moisture content: 13% by weight), 2-(2-isopropyl oxyethoxy)ethanol (boiling point: 207° C., equilibrium moisture content: 18% by weight), isopropyl glycol (boiling point: 142° C., equilibrium moisture content 15% by weight), diethyl diglycol (boiling point: 189° C., equilibrium moisture content: 10% by weight), propyl propylene glycol (boiling point: 150° C., equilibrium moisture content: 17% by weight), dibutyldiglycol (boiling point: 189° C., equilibrium moisture content: 12% by weight), butylpropylene glycol (boiling point 170° C., equilibrium moisture content: 6% by weight), methylpropylene glycol acetate (boiling point: 146° C., equilibrium moisture content: 8% by weight), tributyl citrate (boiling point: 234° C., equilibrium moisture content: 4% by weight), propyl propylene diglycol (boiling point: 220° C., equilibrium moisture content: 5% by weight), butyl propylene glycol (boiling point: 170° C., equilibrium moisture content: 6% by weight), butyl propylene diglycol (boiling point: 212° C., equilibrium moisture content: 3% by weight), methyl propylene glycol acetate (boiling point: 146° C., equilibrium moisture content: 8% by weight), and triethylene glycol dimethyl ether (boiling point: 216° C., equilibrium moisture content: 20% by weight), and 2-methyl-1,3-butane diol (boiling point: 203° C., equilibrium moisture content: 23% by weight).

The following can be also used as the organic solvent.

Dipropylene glycol (boiling point: 232° C.), 1,5-pentane diol (boiling point: 242° C.), propylene glycol (boiling point: 187° C.), 2-methyl-2,4-pentane diol (boiling point: 197° C.), ethylene glycol (boiling point: 196° C. to 198° C.), tripropylene glycol (boiling point: 267° C.), hexylene glycol (boiling point: 197° C.), polyethylene glycol (viscostic liquid to solid), polypropylene glycol (boiling point: 187° C.), 1,6-hexane diol (boiling point: 253° C. to 260° C.), 1,2,6-hexane triol (boiling point: 178° C.), trimethylol ethane (solid; melting point: 199° C. to 201° C.), and trimethylol propane (solid; melting point: 61° C.).

Specific examples of the polyol alkyl ethers include, but are not limited to, ethylene glycol monoethyl ether (boiling point: 135° C.), ethylene glycol monobutyl ether (boiling point: 171° C.), diethylene glycol monomethyl ether (boiling point: 194° C.), diethylene glycol monoethyl ether (boiling point: 197° C.), diethylene glycol monobutyl ether (boiling point:

231° C.), ethylene glycol mono-2-ethylhexyl ether (boiling point: 229° C.), and propylene glycol monoethyl ether (boiling point: 132° C.).

Specific examples of the polyol aryl ethers include, but are not limited to, ethylene glycol monophenyl ether (boiling point: 237° C.) and ethylene glycol monobenzyl ether.

Specific examples of the nitrogen-containing heterocyclic compounds include, but are not limited to, 2-pyrolidone (boiling point: 250° C., melting point: 25.5° C., 47% by weight to 48% by weight), N-methyl-2-pyrolidone (boiling point: 202° C.), 1,3-dimethyl-2-imidazolidinone (boiling point: 226° C.), ϵ-caprolactam (boiling point: 270° C.), and y-butylolactone (boiling point: 204° C. to 205° C.).

Specific examples of the amides include, but are not limited to, formamide (boiling point: 210° C.), N-methyl formamide (boiling point: 199° C. to 201° C.), N,N-dimethylformamide (boiling point: 153° C.), and N,N-diethylformamide (boiling point: 176° C. to 177° C.).

Specific examples of the amines include, but are not limited to, monoethanol amine (boiling point: 170° C.), diethanol amine (boiling point: 268° C.), triethanol amine (boiling point: 360° C.), N,N-dimethyl monoethanol amine (boiling point: 139° C.), N-methyl diethanol amine (boiling point: 243° C.), N-methylethanol amine (boiling point: 159° C.), N-phenyl ethanol amine (boiling point 282° C. to 287° C.), and 3-aminopropyl diethyl amine (boiling point: 169° C.).

Specific examples of the sulfur-containing compounds include, but are not limited to, dimethyl sulphoxide (boiling point: 139° C.), sulfolane (boiling point: 285° C.), and thiodiglycol (boiling point: 282° C.).

The content of the hydrosoluble organic solvent is from 20% by weight to 60% by weight to reduce the occurrence of curling.

When the content is too small, the penetration property of the processing fluid tends to deteriorate, which is disadvantageous to prevent curling.

When the content is too large, the drying property of the processing fluid tends to deteriorate, which is disadvantageous to prevent curling.

Hysrosoluble Agglomerating Agent

As the hydrosoluble agglomerating agent for use in the present disclosure, hydrosoluble organic acids, ammonium salt compound of hydrosoluble organic acids, hydrosoluble metal salts compounds, and hydrosoluble cationic polymers.

When the processing fluid to which the hydrosoluble agglomerating agent is added contacts the ink for inkjet recording on a recording medium, anionic pigments are fixed by agglomeration caused by the salting-out effect or the acid deposition, thereby reducing the occurrence of feathering and color bleeding.

Hydrosoluble aliphatic organic compounds are preferable as the hydrosoluble organic acid.

Specific examples of the hydrosoluble aliphatic organic compounds include, but are not limited to, lactic acid (pKa: 3.83), malic acid (pKa: 3.4), citric acid (pKa: 3.13), tartaric acid (pKa: 2.93), oxalic acid (pKa: 1.04, malonic acid (pKa: 2.05), succinic acid (pKa: 4.21), adipic acid (pKa: 4.42), acetic acid (pKa: 4.76), propionic acid (pKa: 4.87), butyric acid (pKa: 4.82), valeric acid (pKa: 4.82), gluconic acid (pKa: 2.2), pyruvic acid (pKa: 2.49), and fumaric acid (pKa: 3.02).

As the ammonium salts of the hydrosoluble organic acid, ammonium salts of hydrosoluble aliphatic organic acids are preferable. Specific examples of the ammonium salts of hydrosoluble aliphatic organic acids include, but are not limited to, ammonium acetate, ammonium lactate, ammonium propionate, and butanedioic ammonium.

As the metal salt compounds, hydrosoluble poly-valent metal salt compounds and hydrosoluble monoalkali metal salt compound are suitable. Specific examples of the hydrosoluble poly-valent metal salts include, but are not limited to, magnesium sulfate, aluminum sulfate, manganese sulfate, nickel sulfate, ferric sulfate (II), copper sulfate (II), zinc sulfate, ferric nitride (II), ferric nitride (III), cobalt nitride, strontium nitride, copper nitride (II), nickel nitride (II), lead nitride (II), manganese nitride (II), calcium nitride (II), nickel chloride (II), calcium chloride, tin chloride (II), calcium chloride, tin chloride (II), strontium chloride, barium chloride, and magnesium chloride.

Specific examples of the hydrosoluble monoalkali metal salt compound include, but are not limited to, sodium sulfate, potassium sulfate, lithium sulfate, sodium hydrogen sulfate, potassium hydrogen sulfate, sodium nitride, potassium nitride, sodium carbonate, potassium carbonate, sodium hydrogen carbonate, potassium hydrogen carbonate, sodium chloride, and potassium chloride.

As the hydrosoluble metal salt compounds, hydrosoluble polymetal salts are preferable.

As the hydrosoluble cationic polymers, quaternary ammonium salt type cationic polymer are preferable.

Specific examples of the quaternary ammonium salt type cationic polymer include, but are not limited to, dialkyl aryl ammonium chloride polymers, dialkylamino ethyl(meth) acrylate quaternary ammonium salt polymers, modified polyvinyl alcohol dialkyl ammonium salt polymers, and dialkyl diaryl ammonium salt polymers.

Specific examples of the other cationic polymers include, but are not limited to, cationic epichlorohydrin condensation compounds, cationic specially-modified polyamine compounds, cationic polyamide polyamine compounds, cationic urea-formarine resin compounds, cationic polyacrylic amide compounds, cationic alkyl ketene dimers, cationic dicyan diamide compounds, cationic dicyan diamide-formarine condensation compounds, cationic dicyan diamide-polyamine condensation compounds, cationic polyvinyl formamide compounds, cationic polyvinyl pyridine compounds, cationic polyalkylene polyamine compounds, and cationic epoxy polyamide compounds.

Among these, the compounds represented by the following Chemical Structures are particularly preferable.

Chemical Structure 1

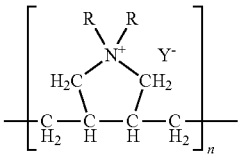

In the Chemical Structure 1, "R" represents a methyl group or an ethyl group and "X-" represents a halogen ion. "n" represents an integer.

Chemical Structure 2

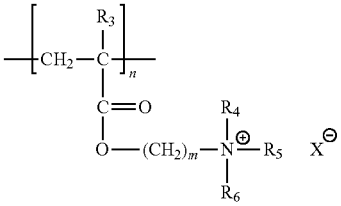

In the Chemical Structure 2, "X-" represents a negative ion of a halogen ion, nitric acid ion, nitrite ion, or acetic acid ion, "$R_3$" represents H or $CH_3$, $R_3$, $R_4$, and $R_5$ independently represent H or alkyl groups. "n" represents an integer and "m" represents an integer of from 1 to 3.

Chemical Structure 3

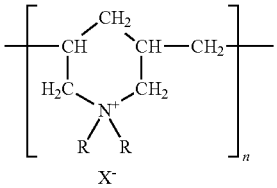

In the Chemical Structure 3, "R" represents a methyl group or an ethyl group, "X-" represents a negative ion of a halogen ion, nitric acid ion, nitrite ion, or acetic acid ion. "n" represents an integer.

The cationic polymers agglomerate the coloring material and the hydrodispersible resins in the ink and leave the coloring material on the surface of plain paper, thereby increasing the image density and reducing the text blurring.

As the hydrosoluble agglomerating agents, hydrosoluble organic acids, ammonium salts thereof, and polyvalent metal salts are preferable.

Among these, hydrosoluble organic acids and ammonium salts thereof are particularly preferable.

The addition amount of the hydrosoluble agglomerating agent is preferably from 0.1% by weight to 30% by weight and more preferably from 1% by weight to 20% by weight based on the total amount of the processing fluid as the effective component.

When the addition amount is too large, the hydrosoluble organic compound tends not to be sufficiently dissolved but precipitate. When the addition amount is too small, the image density is not easily improved.

Surface Active Agent

As the surface active agents for use in the processing fluid, at least one surface active agent selected from the group consisting of silicone-based surface active agents and fluorine-containing surface active agents is preferable. These surface active agents may be used alone or in combination.

Specific examples of the fluorine-containing surface active agents for use in the processing fluid include, but are not limited to, SURFLON S-111, SURFLON S-112, SURFLON S-113, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC-129, FC-135, FC-170C, FC-430, FC-431, an FC-4430 (all manufactured by SUMITOMO 3M); MEGAFAC F-470, F-1405, F-474, and F-444 (all manufactured by DIC CORPORATION); ZONYL FS-300, FSN, FSO-100, and FSO (all manufactured by DU PONT KABUSHIKI KAISHA); and F-top EF-351, EF-352, EF-801, and EF-802 (all manufactured by Mitsubishi Materials Electronic Chemicals Co., Ltd.).

Among these, ZONYL FS-300, FSN, FSO-100, and FSO (all manufactured by DU PONT KABUSHIKI KAISHA) are particularly suitable in terms of the reliability and improvement on coloring.

Specific examples of the silicone-based surface active agents include, but are not limited to, modified silicone KF-351A, KF-353A, KF-354L, KF-355A, KF-615A, KF-640, KF-642, KF-643, and KF-6011 (all manufactured by Shin-Etsu Chemical Co., Ltd.); SILICONE FZ-77, FZ-2104, FZ-2105, and L-7604 (all manufactured by DOE CORNING TORAY CO., LTD.).

Among these, KF-355A, KF-640, KF-642, and KF-643 (all manufactured by Shin-Etsu Chemical Co., Ltd.) are particularly suitable in terms of the reliability and improvement on coloring.

The content of the surface active agents in the processing fluid is preferably from 0.01% by weight to 3.0% by weight and more preferably from 0.5% by weight to 2% by weight.

When the content is too small, the effect of the surface active agent tends to be weak. A content that is too large tends to cause a problem with regard to the preservation stability.

Other Components

Sugar groups are also preferable as the other solid wetting agents.

Specific examples of the sugar groups include, but are not limited to, monosaccharides, disaccharides, oligosaccharides (including trisaccharides and tetrasaccharides), and polysaccharides.

Specific examples thereof include, but are not limited to, glucose, mannose, fructose, ribose, xylose, arabinose, galactose, maltose, cellobiose, lactose, saccharose, trehalose, and maltotriose.

Polysaccharides represent sugar in a broad sense and are materials that are present widely in nature, for example, α-cyclodextrine and cellulose.

In addition, specific examples of derivatives of these sugar groups include, but are not limited to, reducing sugars (for example, sugar alcohols (represented by $HOCH_2(CHOH)_nCH_2OH$, where n represents an integer of from 2 to 5) of the sugar groups specified above, oxidized sugars (e.g., aldonic acid and uronic acid), amino acid, and thio acid.

Among these, sugar alcohols are preferable and specific examples thereof include, but are not limited to, maltitol and sorbit.

The processing fluid for use in the present disclosure preferably has at least one kind of non-wetting agent polyol compounds or glycol ether compounds having 8 to 11 carbon atoms.

A penetrating agent having a solubility of from 0.2% by weight to 50% by weight in water at 25° C. is preferable.

Among these, 2-ethyl-1,3-hexane diol (solubility: 4.2% at 25° C.) and 2,2,4-trimethyl-1,3-pentane diol (solubility: 2.0% at 25° C.) are particularly preferable.

Specific examples of the other non-wetting agent polyol compounds include, but are not limited to, aliphatic diols such as 2-ethyl-2-methyl-1,3-propanediol, 3,3-dimethyl-1,2-butane diol, 2,2-diethyl-1,3-propane diol, 2-methyl-2-propyl-1,3-propane diol, 2,4-dimethyl-2,4-pentane diol, 2,5-dimethyl-2,5-hexane diol, and 5-hexene-1,2-diol.

Any other penetrating agents that can be dissolved in the processing fluid and adjusted to have desired characteristics can be used in combination.

Specific examples thereof include, but are not limited to, alkyl and aryl ethers of polyols such as diethylene glycol monophenylether, ethylene glycol monophenylether, ethylene glycol monoaryl ether, diethylene glycol monophenyl ether, diethylene glycol monobutyl ether, propylene glycol monobutyl ether, and tetraethylene glycol chlorophenyl ether and lower alcohols such as ethanol.

The content of the penetrating agent in the processing fluid is preferably from 0.1% by weight to 5.0% by weight.

When the content is too small, the effect of penetrating the ink for inkjet recording tends to reduce. When the content is too large, the effect of improving the penetration by separating the ink from the solvent is easily saturated since the solubility of the ink in the solvent is low.

The processing fluid for use in the present disclosure may contain antiseptic agents and corrosion control agents for use in the ink for inkjet recording describe below.

Ink for Inkjet

The ink for inkjet recording for use in the present disclosure contains a hydrodispersible coloring agent serving as a coloring material, a hydrosoluble organic solvent, a surface active agent, a penetrating agent, and water.

Hydrodispersible Coloring Agent

Although pigments are dominantly used as the hydrodispersible coloring agent for the ink for inkjet recording considering the weather resistance, dyes can be also contained in the ink for color adjustment unless the dyes degrade the weather resistance.

There is no specific limitation to the pigments. For example, inorganic pigments or organic pigments for black or color are suitable. These can be used alone or in combination.

Specific examples of the inorganic pigments include, but are not limited to, titanium oxide, iron oxide, calcium oxide, barium sulfate, aluminum hydroxide, barium yellow, cadmium red, chrome yellow, and carbon black manufactured by known methods such as contact methods, furnace methods, and thermal methods.

Specific examples of the organic pigments include, but are not limited to, azo pigments (azo lakes, insoluble azo pigments, condensed azo pigments, chelate az pigments, etc.), polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinofuranone pigments, etc.), dye chelates (basic dye type chelates, acid dye type chelates), nitro pigments, nitroso pigments, and aniline black.

Among these pigments, pigments having good affinity with water are preferable in particular.

More preferred specific examples of the pigments for black include, but are not limited to, carbon black (C.I. Pigment Black 7) such as furnace black, lamp black, acetylene black, and channel black, metals such as copper and iron (C.I. Pigment Black 11), metal compounds such as titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 128, 138, 150, 151, 153, and 183; C.I. Pigment Orange 5, 13, 16, 17, 36, 43, and 51; C.I. Pigment Red 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 185, 190, 193, 209, and 219; C.I. Pigment Violet 1 (Rohdamine Lake), 3, 5:1, 16, 19, 23, and 38; C.I. Pigment Blue 1, 2, 15, 15:1, 15:3 (Phthalocyanine Blue), 16, 17:1, 56, 60, and 63; C.I. Pigment Green 1, 4, 7, 8, 10, 17, 18, and 36.

The following first and second forms are preferable in the case in which the coloring agent is a pigment.

1) In the first form, the coloring agent contains a polymer emulsion (water dispersion material of polymer particulates containing a coloring material) in which the polymer particulates contains the coloring material having no or little solubility in water.

2) In the second form, the coloring agent contains a pigment that has at least one kind of hydrophillic group on the surface and is hydrodispersible under the presence of no dispersing agent (hereinafter referred to as self-dispersible pigment).

In the present disclosure, in the case of the second form, it preferably contains the hydrodispersible resins specified below.

As the first-form hydrodispersible coloring agent, in addition to the pigment specified above, it is preferable to use a polymer emulsion in which polymer particulates contain the pigment.

The polymer emulsion in which polymer particulates contain the pigment means an emulsion in which the pigments are encapsulated in the polymer particulates or adsorbed on the surface of the polymer particulates.

This case, it is not necessary that all the pigments are encapsulated or adsorbed and some of the pigments may be dispersed in the emulsion unless they have an adverse impact on the effect of the present disclosure.

Specific examples of the polymers (polymer in the polymer particulates) forming the polymer emulsions include, but are not limited to, vinyl-based polymers, polyester-based polymers, and polyurethane-based polymers. Among these, vinyl-based polymers and polyester-based polymers are particularly preferably used and the polymers specified in JP-2000-53897-A and JP-2001-139849-A are suitably used.

In addition, compared with pigment particles present alone, the ink that contains hydrodispersible matters of the polymer particulates containing the coloring material of the first form is not affected by scattering of light so that the ink has excellent color reproducibility and the polymer particulates also serve as a binder, thereby improving the abrasion resistance of the image forming materials.

The volume average particle diameter (D50) of the hydrodispersion matters of the polymer particulates containing the coloring material is preferably from 0.01 μm to 0.20 μm in the ink.

The self dispersible pigment of the second form is surface-reformed in order that at least one hydrophilic group is bonded with the surface of the pigment directly or via another atom group.

To conduct this surface reforming, a particular functional group (functional group such as sulfone group or carboxyl group) is chemically bonded on the surface of the pigment or the surface is wet-oxidized using at least one of hypohalous acid or a salt thereof.

Among these, a form is preferable in which a carboxyl group is bonded on the surface of the pigment which is dispersed in water.

Since the pigment is surface-reformed and the carboxyl group is bonded thereto, printing quality is improved and water resistance of the recording media after printing is improved in addition to improvement of the dispersion stability.

In addition, since the ink that contains the second form self dispersible pigment has an excellent re-dispersibility after drying, clogging does not occur even when the ink moisture around the inkjet head nozzles evaporates while the printing device is suspended for a long time. Therefore, quality images can be produced again by a simple cleaning operation.

The volume average particle diameter (D50) of the self dispersible pigment is preferably from 0.01 μm to 0.20 μm in the ink.

For example, self-dispersible carbon black having an ionic property is preferable and an anionic-charged self-dispersible carbon black is more preferable.

Specific examples of the anionic hydrophilic groups includes, but are not limited to, —COOM, —$SO_3M$, —$PO_3HM$, and —$PO_3M_2$ (M represents an alkali metal, ammonium, or an organic ammonium).

R represents an alkyl group having 1 to 12 carbon atoms, a substituted or non-substituted phenyl group, or a substituted or non-substituted naphtyl group. Among these, it is preferable to use pigments in which —COOM or —$SO_3M$ are bonded on the surface.

Specific examples of the alkali metal of M in the hydrophilic group include, but are not limited to, lithium, sodium, and potassium.

Specific examples of the organic ammonium include, but are not limited to, mono, di, or tri-methyl ammonium, mono, di, or tri-ethyl ammonium, and mono, di, or tri-methanol ammonium.

To obtain the anionic-charged color pigment, —COONa is introduced to the surface of the color pigment. For example, there are oxidizing methods using sodium hypochlorite, methods by sulfonating, and methods of using reaction of diazonium salt. The hydrophilic group can be bonded with the surface of carbon black via another atom group.

Specific examples of such atom groups include, but are not limited to, an alkyl group having 1 to 12 carbon atoms, a substituted or non-substituted phenyl group, or a substituted or non-substituted naphtyl group.

Specific examples of the cases in which the hydrophilic group is bonded with the surface of carbon black via another atom group include, but are not limited to —$C_2H_4COOM$ (M represents an alkali metal or quaternary ammonium), —$PhSO_3M$ (Ph represents a phenyl group. M represents alkali metal or quaternary ammonium).

The content of the coloring agent in the ink for inkjet recording is preferably from 2% by weight to 15% by weight in a solid form and more preferably from 3% by weight to 12% by weight When the content is too small, the color of the ink tends to deteriorate and the image density tend to decrease. When the content is too large, the viscosity of the ink tends to increase, thereby degrading the ink discharging performance, which is not preferable.

Hydrosoluble Organic Solvent

As the hydrosoluble organic solvent for use in the ink for inkjet recording, the hydrosoluble organic solvents for use in the processing fluid are suitably used.

The hydrosoluble organic solvent A having a high equilibrium moisture content are particularly suitable.

The mass ratio of the hydrosoluble coloring agent to the hydrosoluble organic solvent in the ink for inkjet recording has an impact on the discharging stability of the ink from the recording head.

If the blending amount of the hydrosoluble organic solvent is small while the amount of the solid portion of the hydrosoluble coloring agent is large, water around ink meniscus of the nozzles tends to evaporate quickly, thereby causing poor discharging performance.

The content of the hydrosoluble organic solvent in the ink for inkjet recording is preferably from 20% by weight to 50% by weight and more preferably from 20% by weight to 45% by weight When the content is too small, the discharging stability tends to deteriorate and waste ink easily fixates to the maintenance unit of the inkjet recording device.

In addition, when the content is too large, the drying property of the ink on recording media (typically, paper) tends to be inferior and the text quality on plain paper may deteriorate.

Surface Active Agent

As the surface active agent for use in the ink for inkjet recording, it is preferable to use a surface active agent that has a low surface tension, a high penetrating property, and an excellent leveling property without degrading the dispersion stability irrespective of the kind of the coloring agent and the combinational use with the hydrosoluble organic solvent.

At least a surface active agent selected from the group consisting of anionic surface active agents, nonionic surface active agents, silicone-containing surface active agents, and fluorine-containing surface active agents is preferable.

Among these, silicone-containing surface active agents and fluorine-containing surface active agents are particularly preferred.

These surface active agents may be used alone or in combination.

As the surface active agent for use in the ink for inkjet recording, the surface active agent for use in the processing fluid are suitably used.

The content of the surface active agents in the ink for inkjet recording is preferably from 0.01% by weight to 3.0% by weight and more preferably from 0.5% by weight to 2% by weight.

When the content is too small, the effect of the surface active agent tends to become weak. When the content is too large, the penetration of the ink to a recording medium tends to become excessive, resulting in decrease in the image density and occurrence of strike-through.

Penetrating Agent

As the penetrating agent for use in the ink for inkjet recording, the penetrating agent for use in the processing fluid is suitably used.

The content of the penetrating agent in the ink for inkjet recording is preferably from 0.1% by weight to 4.0% by weight.

When the content is too small, the obtained image may not dry soon, resulting in an blurred image. When the content is too large, the dispersion stability of the coloring agent may deteriorate, the nozzles tend to clog, and the penetration of the ink into the recording medium tends to become excessive, which leads to a decrease in the image density and occurrence of strike-through.

Hydrodispersible Resin

Hydrodispersible resins have excellent film-forming (image forming) property, water repellency, water-resistance, and weather resistance. Therefore, these are suitable for image recording requiring high water-resistance and high image density.

Specific examples thereof include, but are not limited to, condensation-based resins, addition-based resins, and natural polymers.

Specific examples of the condensation-based synthesis resins include, but are not limited to, polyester resins, polyurethane resins, polyepoxy resins, polyamide resins, polyether resins, poly(meth)acrylic resins, acrylic-silicone resins, and fluorine-containing resins.

Specific examples of the addition-based resins include, but are not limited to, polyolefin resins, polystyrene resins, polyvinyl alcohol resins, polyvinyl ester resins, polyacrylic acid resins, and unsaturated carboxylic acid resins.

Specific examples of the natural resins include, but are not limited to, celluloses, rosins, and natural rubber.

Among these, polyurethane resin particulates, acrylic-silicone resin particulates, and fluorine-containing resin particulates are preferable. These can be used alone or in combination.

As the fluorine-containing resin particulates, fluorine-containing resin particulates having fluoro-olefin units are preferable. Among these, fluorine-containing vinyl ether resin particulates formed of fluoro-olefin units and vinyl ether units are particularly preferable.

There is no specific limitation to the fluoro-olefin units. Specific examples thereof include, but are not limited to, —$CF_2CF_2$—, —$CF_2CF(CF_3)$—, and —$CF_2CFCl$—.

There is no specific limitation to the vinyl ether unit. For example, the compounds represented by the following Chemical Structures are suitable.

U1

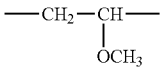

U2

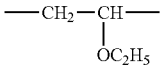

U3

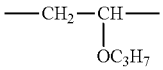

U4

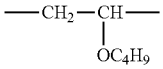

U5

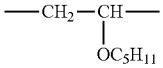

U6

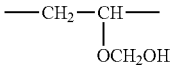

U7

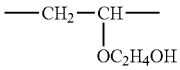

U8

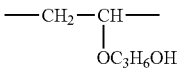

U9

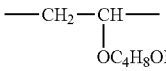

U10

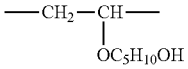

U11

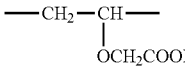

U12

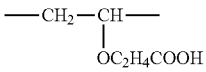

U13

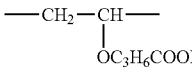

U14

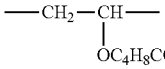

U15

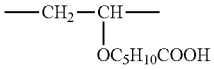

U16

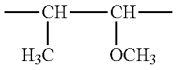

-continued

U17

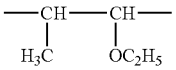

U18

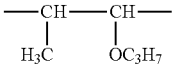

U19

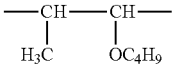

U20

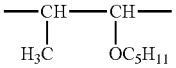

U21

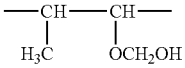

U22

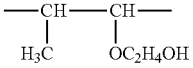

U23

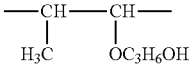

U24

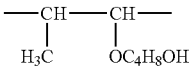

U25

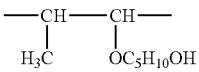

U26

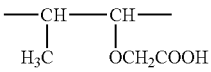

U27

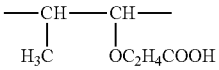

U28

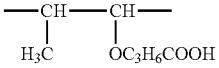

U29

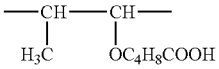

U30

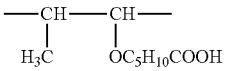

As the fluorine-containing vinyl ether resin particulates formed of the fluoro-olefin units and the vinyl ether units, alternate copolymers in which the fluoro-olefin units and the vinyl ether units are alternately co-polymerized are preferable.

Any suitably synthesized fluorine-containing resin particulates and products thereof available in the market can be used.

Specific examples of the products available in the market include, but are not limited to, FLUONATE FEM-500, FEM-600, DICGUARD F-52S, F-90, F-90M, F-90N, and AQUA FURAN 1E-5A (all manufactured by DIC CORPORATION); and LUMIFLON FE4300, FE4500, and FE4400, ASAHI GUARD AG-7105, AG-950, AG-7600, AG-7000, and AG-1100 (all manufactured by ASAHI GLASS CO., LTD.).

The hydrodispersible resins can be used as homopolymers or complex resins as copolymers. Any of single phase structure type, core-shell type, and power feed type emulsions is suitable.

A hydrodispersible resin that has a hydrophilic group with self dispersiblity or no dispersibility while dispersibility is imparted to a surface active agent or a resin having hydrophilic group can be used as the hydrodispersible resin.

Among these, emulsions of resin particles obtained by emulsification polymerization or suspension polymerization of ionomers or unsaturated monomers of a polyester resin or polyurethane resin are most suitable.

In the case of emulsification polymerization of an unsaturated monomer, since a resin emulsion is obtained by reaction in water to which an unsaturated monomer, a polymerization initiator, a surface active agent, a chain transfer agent, a chelate agent, a pH adjusting agent, etc. are added, it is easy to obtain a hydrodispersible resin and change the resin components. Therefore, a hydrodispersible resin having target properties is easily obtained.

Specific examples of the unsaturated monomers include, but are not limited to, unsaturated carboxylic acids, monofunctional or poly-functional (meth)acrylic ester monomers, (meth)acrylic amide monomers, aromatic vinyl monomers, vinyl cyano compound monomers, vinyl monomers, arylated compound monomers, olefin monomers, dien monomers, and oligomers having unsaturated carbon. These can be used alone or in combination.

When these monomers are used in combination, the resin properties can be easily reformed. The resin properties can be reformed by polymerization reaction and graft reaction using an oligomer type polymerization initiators.

Specific examples of the unsaturated carboxylic acids include, but are not limited to, acrylic acid, methacrylic acid, itaconic acid, fumaric acid, and maleic acid.

Specific examples of the mono-functional (meth)acrylic ester monomers include, but are not limited to, methyl methacrylate, ethyl methacrylate, isopropyl methacrylate, n-butyl methacrylate, isobutyl methacrylate, n-amyl methacrylate, isoamyl methacrylate, n-hyxyl methacrylate, 2-ethylhexyl methacrylate, octyl methacrylate, decyl methacrylate, dodecyl methacrylate, octadecyl methacrylate, cyclohexyl methacrylate, phenyl methacrylate, benzyl methacrylate, glycidyl methacrylate, 2-hydroxyethyl methacrylate, 2-hydroxypropyl methacrylate, dimethyl aminoethyl methacrylate, methacryloxy ethyltrimethyl ammonium salts, 3-methcryloxy propyl trimethoxy silane, methyl acrylate, ethylacrylate, isopropyl acrylate, n-butyl acrylate, isobutyl acrylate, n-amyl acrylate, isoamyl acrylate, n-hexyl acrylate, 2-ethylhexyl acrylate, octyl acrylate, decyl acrylate, dodecyl acrylate, octadecyl acrylate, cyclohexyl acrylate, phenyl acrylate, benzyl acrylate, glycidyl acrylate, 2-hydroxyethyl acrylate, 2-hydroxypropyl acrylate, dimethyl aminoethyl acrylate, and acryloxy ethyl trimethyl ammonium salts.

Specific examples of the poly-functional (meth)acrylic ester monomers include, but are not limited to, ethylene glycol dimethacrylate, eiethylne glycol dimethacrylate, triethylene glycol dimethacrylate, polyethylene glycol dimethacrylate, 1,3-butylene glycol dimethacrylate, 1,4-butylene glycol dimethacrylate, 1,6-hexane diol dimethacrylate, neopentyl glycol dimethacrylate, dipropylene glycol dimethacrylate, polypropylene glycol dimethacrylate, polybutylene glycol dimethacrylate, 2,2'-bis(4-methacryloxy diethoxyphenyl) propane, trimethylol propane trimethacrylate, trimethylol ethane trimethacrylate, polyethylene glycol diacrylate, triethylene glycol diacrylate, 1,3-butylene glycol diacrylate, 1,4-butylene glycol diacrylate, 1,6-hexane diol diacrylate, neopentyl glycol diacrylate, 1,9-nonane diol diarylate, polypropylene glycol diacrylate, 2,2'-bis(4-acryloxy propyloxyphenyl)propane, 2,2'-bis(4-acryloxy diethoxyphenyl) propane trimethylol propane triacrylete, trimethylol ethane triacrylate, tetramethylol methane triacrylate, ditrimethylol tetraacrylate, tetramethylol methane tetraacrylate, pentaerythritol tetraacrylate, and dipenta erythritol hexaacrylate.

Specific examples of the (meth)acrylic amide monomers include, but are not limited to, acrylic amides, methacrylic amides, N,N-dimethyl acrylic amides, methylene bis acrylic amides, and 2-acrylic amide-2-methyl propane sulfonates.

Specific examples of the aromatic vinyl monomers include, but are not limited to, styrene, α-methylstyrene, vinyl toluene, 4-t-butyl styrene, chlorostyrene, vinyl anisole, vinyl naphthalene, and divinyl benzene.

Specific examples of the vinyl cyano compound monomers include, but are not limited to, acrylonitrile, and methacrylonitrile.

Specific examples of the vinyl monomers include, but are not limited to, vinyl acetate, vinylidene chloride, vinyl chloride, vinyl ether, vinyl ketone, vinyl pyrolidone, vinyl sulfonic acid and its salts, vinyl trimethoxy silane, and vinyl triethoxy silane.

Specific examples of the arylated compound monomers include, but are not limited to, aryl sulfonic acid and its salts, aryl amine, aryl chloride, diaryl amine, and diaryl dimethyl ammonium salts.

Specific examples of the olefin monomers include, but are not limited to, ethylene and propylene.

Specific examples of the dien monomers include, but are not limited to, butadiene and chloroprene.

Specific examples of the oligomers having unsaturated carbon include, but are not limited to, styrene oligomers having a methacryloyl group, styrene-acrylonitrile oligomers having a methacryloyl group, methyl methacrylate oligomers having a methacryloyl group, dimethyl siloxane oligomers having a methacryloyl group, and polyester oligomers having an acryloyl group.

Since breakage in molecule chains such as dispersion destruction and hydrolytic cleavage occurs to the hydrodispersible resins in a strong alkali or strong acid environment, pH is preferably from 4 to 12, more preferably from 6 to 11, and furthermore preferably from 7 to 9 in terms of the miscibility with the hydrodispersible coloring agent.

The average particle diameter (D50) of the hydrodispersible resin is related to the viscosity of the liquid dispersion. If the compositions are the same, the viscosity of the same solid portion increases as the particle diameter decreases.

To avoid preparing ink having an excessively high viscosity, the average particle diameter (D50) of the hydrodispersible resin is preferably 50 nm or more.

In addition, particles having larger particle diameters, for example, several tens μm, than the size of the nozzle mouth of the inkjet head are not usable.

When large particles smaller than the nozzle mouth are present in the ink, the discharging property of the ink deteriorates.

The average particle diameter (D50) of the hydrodispersible resin in the ink is preferably 200 nm or less and more preferably 150 nm or less not to degrade the ink discharging property.

In addition, preferably the hydrodispersible resin has a feature of fixing the hydrodispersible coloring agent on a recording medium (typically, paper) and forms a film at room temperature to improve the fixing property of the coloring material.

Therefore, the minimum film-forming temperature (MFT) of the hydrodispersible resin is preferably 30° C. or lower.

In addition, when the glass transition temperature of the hydrodisdpersible resin is too low (e.g., −40° C. or lower), the viscosity of the resin film tends to increase, thereby causing the obtained image sheet to increase tackness.

Therefore, the glass transition temperature of the hydrodisdpersible resin is preferably −30° C. or higher.

The content of the hydrodisdpersible resin in the ink for inkjet recording is preferably from 1% by weight to 15% by weight and more preferably from 2% by weight to 7% in a solid form.

The content of the solid portion in the ink for inkjet recording can be measured by, for example, a method of separating only the hydrodispersible coloring agent and the hydrodispersible resin from the ink for the inkjet recording.

When the pigment is used as the hydrodispersible coloring agent, the ratio of the coloring agent to the hydrodisdpersible resin can be measured by evaluating the mass decreasing ratio by thermal mass analysis.

In addition, when the molecule structure of the hydrodispersible coloring agent is known, it is possible to quantify the solid portion of the coloring agent using NMR for pigments or dyes and fluorescent X ray analysis for heavy metal atoms and inorganic pigments, metal-containing organic pigments contained in the molecule structure, and metal-containing dyes.

Other Components

There is no specific limitation to the selection of the other components. Optionally, pH adjusting agents, antisepsis and anti-fungal agents, chelate reagents, anti-corrosion agents, anti-oxidants, ultraviolet absorbers, oxygen absorbers, and photostabilizing agents can be blended in the ink of the present disclosure.

Any pH adjusters that can adjust the pH of prescribed ink for inkjet recording to be from 7 to 11 without having an adverse impact on the ink can be used. Specific examples thereof include, but are not limited to, alcohol amines, hydroxides of alkali metal elements, ammonium hydroxides, phosphonium hydroxides, and alkali metal carbonates.

When the pH is too high or too low, the pH adjuster tends to dissolve a large amount of the inkjet head and an ink supplying unit, which results in modification, leakage, bad discharging performance of the ink, etc.

Specific examples of the alcohol amines include, but are not limited to, diethanol amine, triethanol amine, and 2-amino-2-ethyl-1,3-propane diol.

Specific examples of the alkali metal hydroxides include, but are not limited to, lithium hydroxide, sodium hydroxide, and potassium hydroxide.

Specific examples of the ammonium hydroxides include, but are not limited to, ammonium hydroxide, quaternary ammonium hydroxide, and quaternary phosphonium hydroxide.

Specific examples of the alkali metal carbonates include, but are not limited to, lithium carbonate, sodium carbonate, and potassium carbonate.

Specific examples of the anti-septic and anti-fungal agents include, but are not limited, dehydrosodium acetate, sodium sorbinate, 2-pyridine thiol-1-oxide sodium, sodium benzoate, and pentachlorophenol sodium.

Specific examples of the chelate reagents include, but are not limited to, ethylene diamine sodium tetraacetate, nitrilo sodium triacetate, hydroxyethylethylene diamine sodium triacetate, diethylene triamine sodium quinternary acetate, and uramil sodium diacetate.

Specific examples of the anti-corrosion agents include, but are not limited to, acid sulfite, thiosodium sulfate, ammonium thiodiglycolate, diisopropyl ammonium nitride, pentaerythritol quaternary nitdride, and dicyclohexyl ammonium nitride.

Specific examples of the anti-oxidants include, but are not limited to, phenol-based anti-oxidants (including hindered phenol-based anti-oxidants), amino-based anti-oxidants, sulfur-based anti-oxidants, and phosphorous-based anti-oxidants.

Specific examples of the ultraviolet absorbers include, but are not limited to, benzophenone-based ultraviolet absorbents, benzotriazole-based ultraviolet absorbents, salicylate-based ultraviolet absorbents, cyanoacrylate-based ultraviolet absorbents, and nickel complex salt-based ultraviolet absorbents.

Manufacturing Method of Ink for Inkjet Recording

The ink for inkjet recording for use in the present disclosure is manufactured by dispersing or dissolving the hydrodispersible coloring agent, the hydrosoluble organic solvent, the surface active agent, the penetrating agent, and water with optional components in an aqueous medium followed by stirring and mixing, if desired.

The dispersion and mixing are conducted by a sand mill, a homogenizer, a ball mill, a paint shaker, an ultrasonic dispersing agent, etc. Stirring and mixing can be conducted by a stirrer having a typical stirring wing, a magnetic stirrer, a high speed dispersing device, etc.

Characteristics of Ink for Inkjet Recording

There is no specific limitation to the characteristics of the ink for inkjet recording for use in the present disclosure. For example, the viscosity, the surface tension, etc, are preferably in the following ranges.

The viscosity of the ink for inkjet recording is preferably from 5 mPa·S to 20 mPa·S at 25° C.

When the ink viscosity is 5 mPa·S or greater, the printing density and the text quality are improved.

When the ink viscosity is 20 mPa·S or less, a suitable ink discharging property is secured.

The viscosity can be measured by a viscometer (RE-550L, manufactured by TOM SANGYO CO., LTD.) at 25° C.

The static surface tension of the ink for inkjet recording is preferably from 20 mN/m to 35 mN/m and more preferably from 20 mN/m to 30 mN/m at 25° C.

When the static surface tension of the ink for inkjet recording is within the range of from 20 mN/m to 35 mN/m, the penetrating property is improved, thereby reducing the bleeding so that the drying property for plain paper becomes good.

Since the ink tends to leak into the process layer, the coloring is good and white spots are reduced.

When the surface tension is too strong, the leveling of the ink on a recording medium tends to hardly occur, thereby prolonging the drying time.

There is no specific limitation to the colors of the ink for inkjet recording for use in the present disclosure. For example, yellow, magenta, cyan, and black are suitable.

When an inkset having at least two kinds of colors is used for recording, multiple color images can be formed. When an inkset having all the color combinations is used for recording, full color images can be formed.

The ink for inkjet recording for use in the present disclosure is used in any printer having an inkjet head such as a piezoelectric element type in which ink droplets are discharged by transforming a vibration plate forming the wall of the ink flowing path using a piezoelectric element as a pressure generating device to press the ink in the ink flowing path as described in JP-H2-51734-A; a thermal type in which bubbles are produced by heating ink in the ink flowing path with a heat element as described in JP-S61-59911-A; and an electrostatic type in which ink droplets are discharged by changes of the volume in the ink flowing path caused by transforming a vibration plate that forms the wall surface of the ink flowing path by a force of electrostatic generated between the vibration plate and the electrode while the vibration plate and the electrode are provided facing each other as described in JP-H6-71882-A.

The ink for inkjet recording for use in the present disclosure can be used in a printer having a feature of accelerating fixing of printed images by heating a recording medium and the ink for inkjet recording to 50° C. to 200° C. during, before or after printing.

Recording Medium

As the recording medium, plain paper having no coated layer is suitably used. In general, plain paper having a sizing test of 10 seconds or greater and an air permeability of 5S to 50S used as typical photocopying paper is preferable.

Inkjet Recording Method

The inkjet recording method of the present disclosure has a processing step of applying the processing fluid for use in the present disclosure to a recording medium and an ink flying (discharging) process of flying the ink for inkjet recording for use in the present disclosure to the recording medium by applying stimuli to the ink for inkjet recording to form images on the recording medium to which the processing fluid is applied.

Ink Flying (Discharging) Process

The ink flying process in the image forming method (inkjet recording method) is a process of applying a stimulus (energy) to the ink for inkjet recording to fly (discharge) the ink onto the recording medium on which the processing fluid is coated to form an image on the recording medium.

As the method of forming images on a recording medium by flying the ink for inkjet recording onto the recording medium in the ink flying process, any known inkjet recording method can be used.

Specific examples of such methods include, but are not limited to, an inkjet recording method of scanning a head and an inkjet recording method using aligned heads to record images on a recording medium.

In the ink flying process, there is no specific limitation to the system of driving a recording head serving as the ink flying device. For example, a piezoelectric element actuator using PZT, etc., a system of using a thermal energy, an on-demand type recording head using an actuator, etc. utilizing an electrostatic force, and a charge control type recording head employing continuous spraying system can be used to record images.

In the system using a thermal energy, arbitrarily controlling spraying (discharging) droplets is difficult so that images tend to vary depending on the kind of recording media. This issue can be solved by providing the processing fluid to the recording media, resulting in attainment of stable image quality irrespective of the kinds of the recording media.

Inkjet Recording Device

There are other inkjet recording devices as illustrated in FIGS. 14 to 17.

Figure 14:
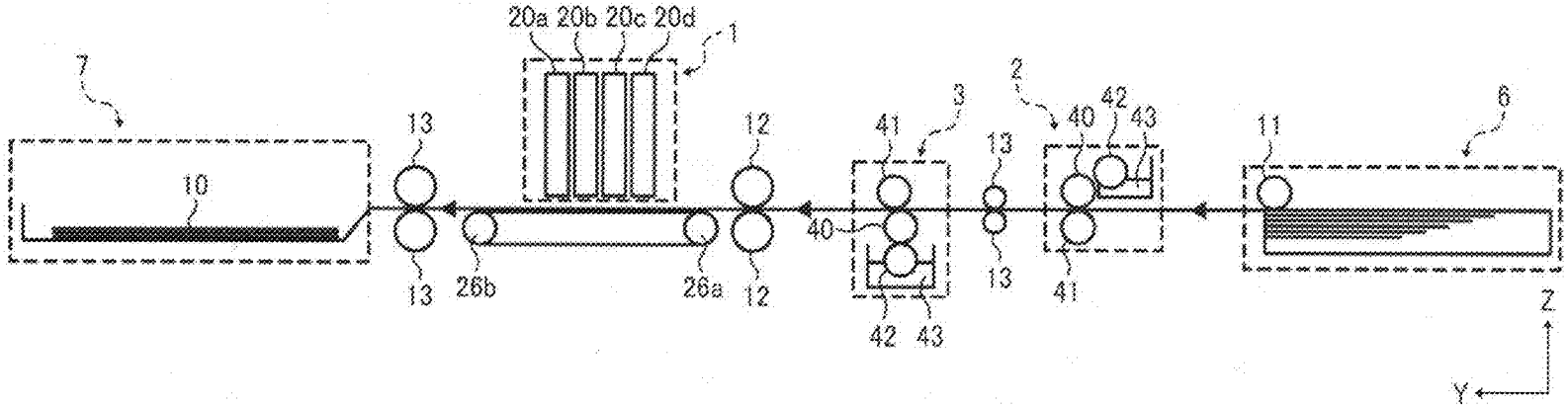
FIG. 14 is a schematic diagram illustrating an example of an inkjet recording device (V)

In the inkjet recording device V illustrated in FIG. 14, the recording medium 10 is sent from the sheet feeder 5 by the sheet feeding roller 11; the processing fluid is uniformly applied to the surface of the recording medium 10 on which an image is secondarily formed by the application roller 40 and the counter roller 41 at the first processing fluid applicator 2; and after the recording medium 10 passes through the transfer route 30, the processing fluid is uniformly applied to the surface of the recording medium 10 on which an image is firstly formed by the application roller 40 and the counter roller 41 at the second processing fluid applicator 3.

The time between when the processing fluid has been applied at the first processing fluid applicator 2 and when the processing fluid is applied at the second processing fluid applicator 3 is controlled by the transfer speed of the recording medium 10.

The recording medium 10 to which the processing fluid is applied is transferred to the inkjet recording unit 1 and after an ink image is formed on the recording medium 10, the recording medium 10 is discharged to the discharging unit by the discharging roller.

The first processing fluid applicator and the second processing fluid applicator are detachably attachable and replaceable.

Figure 15:
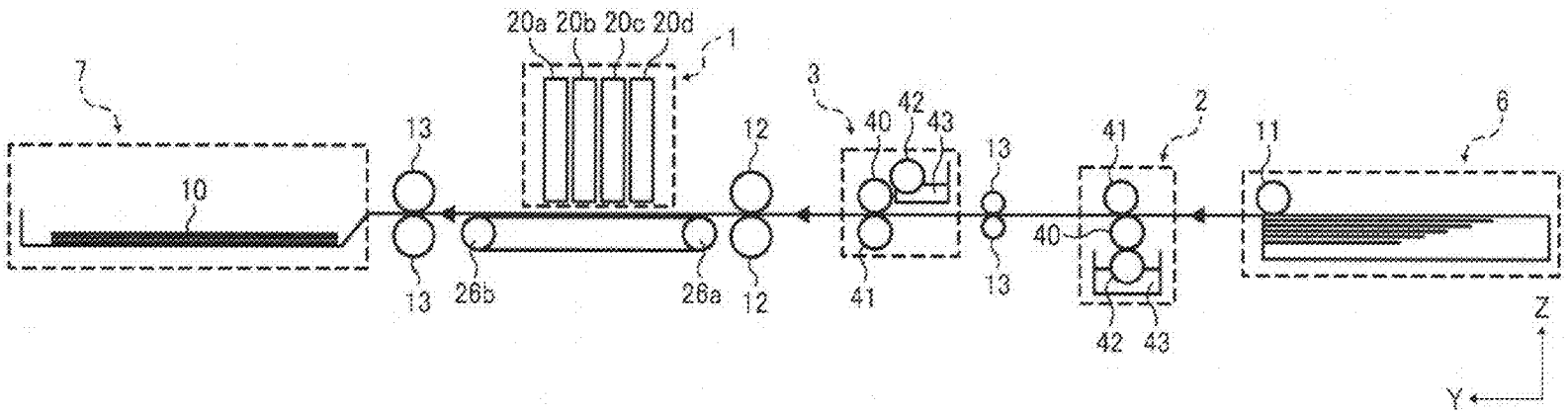
FIG. 15 is a schematic diagram illustrating an example of an inkjet recording device (VI)

The inkjet recording device VI illustrated in FIG. 15 is different from the inkjet recording device V in that the surface to which the processing fluid is firstly applied is the same as the surface on which the ink image is firstly formed and the surface to which the processing fluid is secondly applied is the same as the surface on which the ink image is secondly formed.

Figure 16:
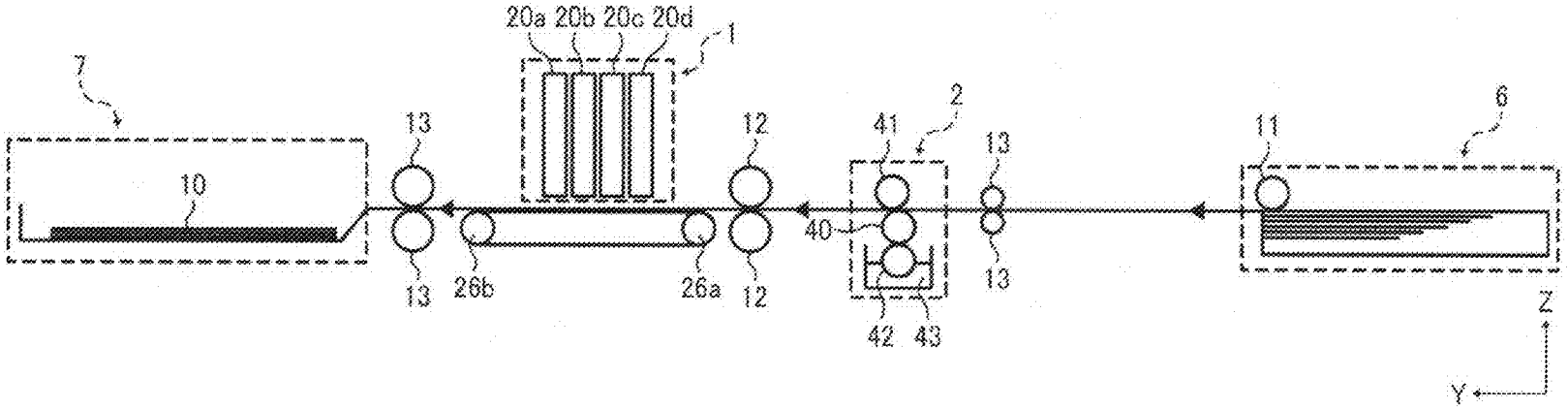
FIG. 16 is a schematic diagram illustrating an example of an inkjet recording device (VII)

The inkjet recording device VII illustrated in FIG. 16 is different from the inkjet recording device V in that the processing fluid is applied only to the surface reverse to the surface on which an ink image is formed.

Figure 17:
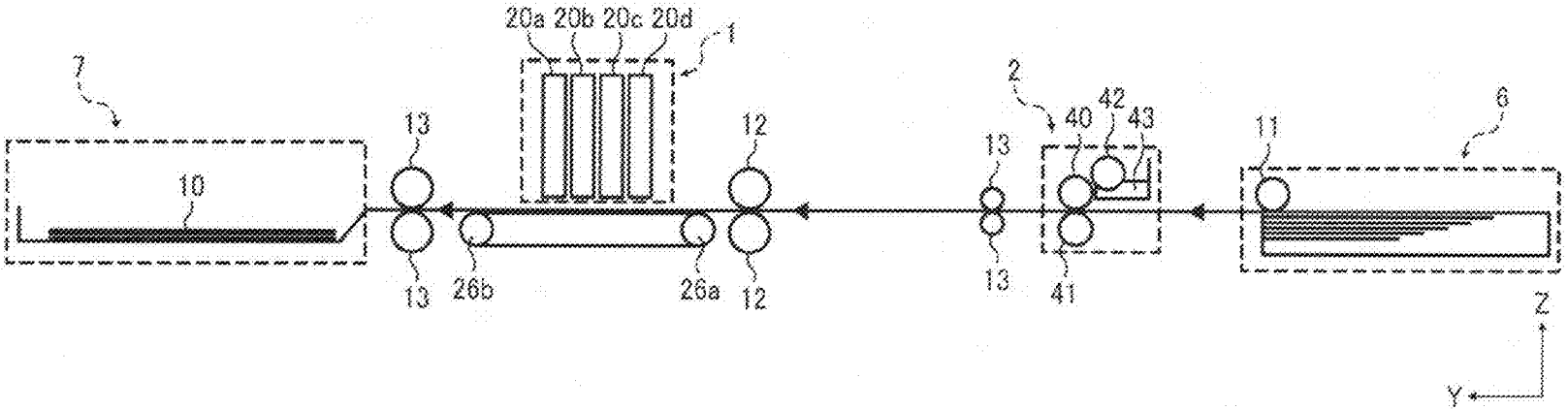
FIG. 17 is a schematic diagram illustrating an example of an inkjet recording device (VIII).

The inkjet recording device VIII of FIG. 17 is different from the inkjet recording device V in that the processing fluid is applied only to the surface on which an ink image is formed.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

Preparation of Process Liquid

Preparation Example 1

Preparation of Process Liquid 1

Process Liquid 1 is prepared as follows.

As shown in Tables 1-1 to 1-4, stir materials of 10 parts of lactic acid (solid portion) serving as the hydrosoluble agglomerating agent, 10 parts (solid portion) of DX-6830 serving as the hydrosoluble agglomerating agent, 5 parts of glycerin serving as the hydrosoluble organic solvent A, 10 parts of β-buthoxy-N,N-dimethyl propionamide serving as the hydrosoluble organic solvent B, 15 parts of 3-methyl-1, 3-hexane diol serving as the hydrosoluble organic solvent B, 0.5 parts of ZONYL FS300 serving as the surface active agent, 0.05 parts of PROXEL GXL serving as a mildew-proofing agent, and deionized water added to make the total parts to be 100 parts for one hour to obtain a uniform mixture.

Filter the thus-obtained processing fluid with a polyvinylidene fluoride membrane filter having an average hole diameter of 5.0 μm under pressure to remove coarse particles and dust to prepare Process Liquid 1.

TABLE 1-1

| Component (% by weight) | | | Process liquid no. 1 | 2 | 3 | 4 | 5 |
|---|---|---|---|---|---|---|---|
| Hydrosoluble agglomerating agent | | Lactic acid (pure component) | | 10 | | | 10 |
| | | Ammonium lactate (pure component) | 10 | | | 10 | |
| | | Calcium lactate (solid portion) | | 1 | | | |
| | | POLYFIX 301 (solid portion) | | | | 10 | |
| | | ARAFIX 255 LOX (solid portion) | | | | | 15 |
| | | DK-6830 (solid portion) | 10 | | | | |
| Hydrosoluble organic agent | A | β-methoxy-N,N'-dimethyl propion amide | | 10 | | 5 | |
| | | Glycerin | 5 | | 5 | | 5 |
| | | 1,3-butane diol | | 10 | | | |
| | B | β-methoxy-N,N'-dimethyl propion amide | 10 | | | 5 | |
| | | 3-methyl-1,3-hexane diol | 15 | | | | |
| | | Propyl propylene diglycol | | 10 | | 20 | 15 |
| | | Triethylene glycol dimethyl ether | | | 20 | | 15 |
| | | 3-methyl-1,3-butane diol | | | 15 | | |
| Surface active agent | | ZONYL FS-300 | 0.5 | | 0.5 | | 0.5 |
| | | SOFTANOL EP-7025 | | 0.5 | | 0.5 | |
| Mildew-proofing agent | | PROXEL GXL | 0.05 | 0.05 | 0.05 | 0.05 | 0.05 |
| | | Pure water | * | * | * | * | * |
| | | Total | 100 | 100 | 100 | 100 | 100 |

TABLE 1-2

| Component (% by weight) | | | Process liquid no. 6 | 7 | 8 | 9 | 10 |
|---|---|---|---|---|---|---|---|
| Hydrosoluble agglomerating agent | | Lactic acid (pure component) | 10 | | 10 | | |
| | | Ammonium lactate (pure component) | | 10 | | 10 | 10 |
| | | Calcium lactate (solid portion) | | | 1 | | |
| | | POLYFIX 301 (solid portion) | | | | | 10 |
| | | ARAFIX 255 LOX (solid portion) | | | | | 15 |
| | | DK-6830 (solid portion) | | 4 | | 10 | |
| Hydrosoluble organic agent | A | β-methoxy-N,N'-dimethyl propion amide | | | | | |
| | | Glycerin | | 10 | | 15 | 20 |
| | | 1,3-butane diol | 5 | | | | 20 |
| | B | β-methoxy-N,N'-dimethyl propion amide | 5 | 5 | | | |
| | | 3-methyl-1,3-hexane diol | 30 | 20 | | 10 | |
| | | Propyl propylene diglycol | | | 35 | | |
| | | Triethylene glycol dimethyl ether | | | 30 | | |
| | | 3-methyl-1,3-butane diol | | 30 | | | 10 |
| Surface active agent | | ZONYL FS-300 | | 0.5 | | 0.5 | |
| | | SOFTANOL EP-7025 | 0.5 | | 0.5 | | |
| Mildew-proofing agent | | PROXEL GXL | 0.05 | 0.05 | 0.05 | 0.05 | 0.05 |
| | | Pure water | * | * | * | * | * |
| | | Total | 100 | 100 | 100 | 100 | 100 |

TABLE 1-3

| Component (% by weight) | | | Process liquid no. 11 | 12 | 13 | 14 | 15 |
|---|---|---|---|---|---|---|---|
| Hydrosoluble agglomerating agent | | Lactic acid (pure component) | 10 | | 10 | | 10 |
| | | Ammonium lactate (pure component) | | 10 | | 10 | |
| | | Calcium lactate (solid portion) | 1 | | 1 | | 1 |
| | | POLYFIX 301 (solid portion) | | | | 5 | |
| | | ARAFIX 255 LOX (solid portion) | | 10 | | | |
| | | DK-6830 (solid portion) | 10 | | | | |
| Hydrosoluble organic agent | A | β-methoxy-N,N'-dimethyl propion amide | | | 5 | | 10 |
| | | Glycerin | 2 | | | 10 | |
| | | 1,3-butane diol | | 3 | | | |
| | B | β-methoxy-N,N'-dimethyl propion amide | | | | | 30 |
| | | 3-methyl-1,3-hexane diol | | 5 | 10 | | 30 |
| | | Propyl propylene diglycol | | 20 | | | |
| | | Triethylene glycol dimethyl ether | 5 | | | 15 | |
| | | 3-methyl-1,3-butane diol | 20 | | | | |
| Surface active agent | | ZONYL FS-300 | 0.5 | | 0.5 | | |
| | | SOFTANOL EP-7025 | | 0.5 | | 0.5 | 0.5 |
| Mildew-proofing agent | | PROXEL GXL | 0.05 | 0.05 | 0.05 | 0.05 | 0.05 |
| | | Pure water | * | * | * | * | * |
| | | Total | 100 | 100 | 100 | 100 | 100 |

TABLE 1-4

| Component (% by weight) | | | Process liquid no. 16 | 17 | 18 | 19 | 20 |
|---|---|---|---|---|---|---|---|
| Hydrosoluble agglomerating agent | | Lactic acid (pure component) | | | | | |
| | | Ammonium lactate (pure component) | 10 | | | | |
| | | Calcium lactate (solid portion) | | | | | |
| | | POLYFIX 301 (solid portion) | | | | | |
| | | ARAFIX 255 LOX (solid portion) | | | | | |
| | | DK-6830 (solid portion) | 5 | | | | |
| Hydrosoluble organic agent | A | β-methoxy-N,N'-dimethyl propion amide | 5 | | | | 10 |
| | | Glycerin | | 10 | 20 | | |
| | | 1,3-butane diol | 10 | | 20 | 3 | |
| | B | β-methoxy-N,N'-dimethyl propion amide | | 5 | | | |
| | | 3-methyl-1,3-hexane diol | | 20 | | 5 | |
| | | Propyl propylene diglycol | | | | 20 | |
| | | Triethylene glycol dimethyl ether | 30 | | | | 15 |
| | | 3-methyl-1,3-butane diol | 30 | 30 | 10 | | |
| Surface active agent | | ZONYL FS-300 | 0.5 | | | 0.5 | |
| | | SOFTANOL EP-7025 | | 0.5 | 0.5 | | 0.5 |
| Mildew-proofing agent | | PROXEL GXL | 0.05 | 0.05 | 0.05 | 0.05 | 0.05 |
| | | Pure water | * | * | * | * | * |
| | | Total | 100 | 100 | 100 | 100 | 100 |

Specifications about compounds in Tables 1-1 and 1-2 are as follows:

Lactic acid: Purity: 85% or more, manufactured by TOKYO CHEMICAL INDUSTRY CO., LTD.

Ammonium lactate: Purity: 66% or more, manufactured by MUSASHINO CHEMICAL LABORATORY, LTD.

Calcium lactate: DL-calcium lactate pentahydrate (purity: 95% or higher), manufactured by WAKO PURE CHEMICAL INDUSTRIES, LTD.

POLYFIX 301: cation polymer (polyamide, epichlorohydrin-based polymer): molecular weight: 3,000, effective component: 30%, manufactured by SHOWA HIGHPOLYMER CO., LTD.

ARAFIX 255 LOX: cation polymer (epichlorohydrin-based polymer), effective component: 25%

DK-6830: cation polymer (polyamide, epichlorohydrin-based polymer): effective component: 55%

ZONYL FS-300: Polyoxyethylene perfluoroalkyl ether (effective component 40% by weight, manufactured by Du Pont Kabushiki Kaisha)

SOFTANOL EP-7025: polyoxyalkylene alkyl ether (component 100% by weight, manufactured by NIPPON SHOKUBAI CO., LTD.)

PROXEL GXL: mildew-proofing agent mainly composed of 1,2-benzisothiazolin-3-one (component: 20% by weight, containing dipropylene glycol, manufactured by Avecia)

Preparation Example 2

Preparation of Process Liquid 2

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 2.

Preparation Example 3

Preparation of Process Liquid 3

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 3.

Preparation Example 4

Preparation of Process Liquid 4

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 4.

Preparation Example 5

Preparation of Process Liquid 5

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 5.

Preparation Example 6

Preparation of Process Liquid 6

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 6.

Preparation Example 7

Preparation of Process Liquid 7

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 7.

Preparation Example 8

Preparation of Process Liquid 8

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 8.

Preparation Example 9

Preparation of Process Liquid 9

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 9.

Preparation Example 10

Preparation of Process Liquid 10

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 10.

Preparation Example 11

Preparation of Process Liquid 11

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 11.

Preparation Example 12

Preparation of Process Liquid 12

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 12.

Preparation Example 13

Preparation of Process Liquid 13

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 13.

Preparation Example 14

Preparation of Process Liquid 14

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 14.

Preparation Example 15

Preparation of Process Liquid 15

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 15.

Preparation Example 16

Preparation of Process Liquid 16

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 16.

Preparation Example 17

Preparation of Process Liquid 17

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 17.

Preparation Example 18

Preparation of Process Liquid 18

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 18.

Preparation Example 19

Preparation of Process Liquid 19

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 19.

Preparation Example 20

Preparation of Process Liquid 20

Stir the materials shown in Tables 1-1 to 1-4 for one hour in the same manner as in Preparation Example 1 to obtain a uniform mixture.

Filter the thus-obtained processing fluid with a polyvinylidene fluoride membrane filter having an average hole diameter of 5.0 μm under pressure to remove coarse particles and dust to prepare Process Liquid 20.

Preparation of Ink for Inkjet Recording

Preparation of Pigment Containing Polymer Particulate Liquid Dispersion

Preparation Example 21

Preparation of Polymer Solution A

After sufficient replacement with nitrogen gas in a flask equipped with a mechanical stirrer, a thermometer, a nitrogen gas introducing tube, a reflux tube, and a dripping funnel, mix 11.2 g of styrene, 2.8 g of acrylic acid, 12.0 g of lauryl methacrylate, 4.0 g of polyethylene glycol methacrylate, 4.0 g of styrene macromer, and 0.4 g of mercapto ethanol in the flask and heat the system to 65° C.; and next, drop a liquid mixture of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer, 3.6 g of mercapto ethanol, 2.4 g of azobisdimethyl valeronitrile, and 18 g of methylethyl ketone in the flask in two and a half hours. Subsequently, drop a liquid mixture of 0.8 g of azobis methyl valeronitrile and 18 g of methylethyl ketone to the flask in half an hour. After one-hour aging at 65° C., add 0.8 g of azobismethyl valeronitrile followed by further one-hour aging. After the reaction is complete, add 364 g of methylethyl ketone to the flask to obtain 800 g of polymer solution A having a concentration of 50% by weight.

Preparation Example 22

Preparation of Magenta Pigment Containing Polymer Particulate Liquid Dispersion

Sufficiently stir 28 g of the polymer solution A, 4.2 g of the magenta coloring material shown in Table 2, 13.6 g of 1 mat potassium hydroxide solution, 20 g of methylethyl ketone, and 13.6 g of deionized water, Mix and knead the mixture using a roll mill; Place the obtained paste in 200 g of deionized water followed by sufficient stirring. Distill away methylethyl ketone and water using an evaporator and remove coarse particles by filtrating the thus-obtained liquid dispersion with a polyvinylidene fluoride membrane filter having an average hole diameter of 5.0 μm under pressure to obtain a pigment containing polymer particulate liquid dispersion containing a pigment in an amount of 15% by weight with a solid portion of 20% by weight.

The average particle diameter (D50) of the polymer particulates in the liquid dispersion of pigment containing polymer particulates is measured and is shown in Table 2.

The average particle diameter (D50) is measured by particle size distribution measuring instrument (NANOTRAC UPA-EX-150, manufactured by NIKKISO CO., LTD.)

TABLE 2

| Pigment containing polymer particulate liquid dispersion | Coloring material | Average particle diameter (D50) |
|---|---|---|
| Magenta pigment containing polymer particulate liquid dispersion | C.I. Pigment Red 122 | 82.7 nm |
| Cyan pigment containing polymer particulate liquid dispersion | C.I. Pigment Blue 15:3 | 110.6 nm |
| Yellow pigment containing polymer particulate liquid dispersion | C.I. Pigment Yellow 74 | 105.4 nm |
| Black pigment containing polymer particulate liquid dispersion | Carbon Black (FW100, manufactured by Degussa AG) | 75.2 nm |

Preparation Example 23

Preparation of Cyan Pigment Containing Polymer Particulate Liquid Dispersion

A cyan pigment containing polymer particulate liquid dispersion is prepared in the same manner as in Preparation Example 22 except that the coloring materials in Preparation Example 22 are replaced with the coloring materials shown in Table 2.

Preparation Example 24

Preparation of Yellow Pigment Containing Polymer Particulate Liquid Dispersion

A yellow pigment containing polymer particulate liquid dispersion is prepared in the same manner as in Preparation Example 22 except that the coloring materials in Preparation Example 22 are replaced with the coloring materials shown in Table 2.

Preparation Example 25

Preparation of Black Pigment Containing Polymer Particulate Liquid Dispersion

A black pigment containing polymer particulate liquid dispersion is prepared in the same manner as in Preparation Example 22 except that the coloring materials in Preparation Example 22 are replaced with the coloring materials shown in Table 2.

Preparation of Ink for Inkjet Recording

Preparation Example 25

Preparation of Ink 1 for Inkjet Recording

Prepare Ink 1 for Inkjet Recording as Follows

Mix a hydrosoluble organic solvent (wetting agent), a penetrating agent, a surface active agent, and a mildew-proofing agent and water shown in Table 3 followed by a one-hour stirring for uniform mixing.

In addition, depending on the liquid mixture, add a hydrodispersible resin to the liquid mixture followed by one hour stirring and thereafter add a pigment liquid dispersion, a defoaming agent, and a pH adjuster to the resultant followed by one hour stirring.

Filter the thus-obtained liquid dispersion with a polyvinilydene fluoride membrane filter having an average hole diameter of 5.0 μm under pressure to remove coarse particles and dust to prepare magenta ink for inkjet recording of Ink 1.

TABLE 3-1

| | | Ink Preparation Example No. | | | |
|---|---|---|---|---|---|
| | Component (% by weight) | 1 | 2 | 3 | 4 |
| Pigment | Magenta pigment containing polymer pigment liquid dispersion | 33.3 | | | |
| | Cyan pigment containing polymer pigment liquid dispersion | | 33.3 | | |

TABLE 3-1-continued

| | Component (% by weight) | Ink Preparation Example No. 1 | 2 | 3 | 4 |
|---|---|---|---|---|---|
| | Yellow pigment containing polymer pigment liquid dispersion | | | 33.3 | |
| | Black pigment containing polymer pigment liquid dispersion | | | | 50.0 |
| | Magenta pigment liquid self-dispersion (CAB-O-JET260) | | | | |
| | Cyan pigment liquid self-dispersion (CAB-O-JET250) | | | | |
| | Yellow pigment liquid self-dispersion (CAB-O-JET270) | | | | |
| | Black pigment liquid self-dispersion (CAB-O-JET300) | | | | |
| Hydrodispersible resin | Fluorine containing resin emulsion | | | | |
| | Acrylic silicone resin emulsion | 2.0 | 3.0 | 2.0 | 5.0 |
| | 1,3-butane diol | 21.8 | 26.0 | 26.0 | |
| | 3-methyl-1,3-butane diol | | | | 16.0 |
| | 2-pyrrolidone | | | | |
| | Glycerin | 14.5 | 13.0 | 13.0 | 16.0 |
| Penetrating agent | 2-ethyl-1,3-hexane diol | 1.0 | 1.0 | 1.0 | 1.0 |
| | 2,2,4-trimethyl-1,3-pentane diol | 1.0 | 1.0 | 1.0 | 1.0 |
| Surface active agent | KF-640 | | | | |
| | SOFTANOL EP-7025 | 1.0 | 1.0 | 1.0 | 1.0 |
| Mildew-proofing agent | PROXEL GXL | 0.1 | 0.1 | 0.1 | 0.1 |
| Defoaming agent | Silicone defoaming agent KM-72F | 0.1 | 0.1 | 0.1 | 0.1 |
| pH adjuster | 2-amino-2-ethyl-1,3-propane diol | 0.3 | 0.3 | 0.3 | 0.3 |
| | Deionized water | 25.0 | 21.3 | 22.3 | 9.6 |
| | Total (% by weight) | 100 | 100 | 100 | 100 |

TABLE 3-2

| | Component (% by weight) | Ink Preparation Example No. 1 | 2 | 3 | 4 |
|---|---|---|---|---|---|
| Pigment | 4Magenta pigment containing polymer pigment liquid dispersion | | | | |
| | Cyan pigment containing polymer pigment liquid dispersion | | | | |
| | Yellow pigment containing polymer pigment liquid dispersion | | | | |
| | Black pigment containing polymer pigment liquid dispersion | | | | |
| | Magenta pigment liquid self-dispersion (CAB-O-JET260) | 49.0 | | | |
| | Cyan pigment liquid self-dispersion (CAB-O-JET250) | | 45.0 | | |
| | Yellow pigment liquid self-dispersion (CAB-O-JET270) | | | 45.0 | |
| | Black pigment liquid self-dispersion (CAB-O-JET300) | | | | 50.0 |
| Hydrodispersible resin | Fluorine containing resin emulsion | 6.0 | 8.0 | 8.0 | 6.0 |
| | Acrylic silicone resin emulsion | | | | |
| | 1,3-butane diol | 30.0 | 17.0 | 27.0 | |
| | 3-methyl-1,3-butane diol | | | | 16.0 |
| | 2-pyrrolidone | | | | 2.0 |
| | Glycerin | 10.0 | 17.0 | 9.0 | 16.0 |
| Penetrating agent | 2-ethyl-1,3-hexane diol | 2.0 | 2.0 | 2.0 | 2.0 |
| | 2,2,4-trimethyl-1,3-pentane diol | | | | |
| Surface active agent | KF-640 | 1.0 | 1.0 | 1.0 | 1.0 |
| | SOFTANOL EP-7025 | | | | |
| Mildew-proofing agent | PROXEL GXL | 0.1 | 0.1 | 0.1 | 0.1 |
| Defoaming agent | Silicone defoaming agent KM-72F | 0.1 | 0.1 | 0.1 | 0.1 |
| pH adjuster | 2-amino-2-ethyl-1,3-propane diol | 0.3 | 0.3 | 0.3 | 0.3 |
| | Deionized water | 1.6 | 9.6 | 7.6 | 6.6 |
| | Total (% by weight) | 100 | 100 | 100 | 100 |

Specifications about compounds in Tables 3-1 and 3-2 are as follows:

Magenta pigment containing polymer particulate liquid dispersion is shown in Table 2

Cyan pigment containing polymer particulate liquid dispersion is shown in Table 2

Yellow pigment containing polymer particulate liquid dispersion is shown in Table 2

Black pigment containing polymer particulate liquid dispersion is shown in Table 2

CAB-O-JET 260: pigment solid portion: 11%, magenta self-dispersion pigment, average particle diameter (D50): 125 nm, manufactured by CABOT CORPORATION CAB-O-JET 250: pigment solid portion: 11%, cyan self-dispersion pigment, average particle diameter (D50): 110 nm, manufactured by CABOT CORPORATION CAB-O-JET 270: pigment solid portion: 11%, yellow self-dispersion pigment, average particle diameter (D50): 170 nm, manufactured by CABOT CORPORATION CAB-O-JET 300: pigment solid portion: 11%, black self-dispersion pigment, average particle diameter (D50): 130 nm, manufactured by CABOT CORPORATION Fluorine-containing emulsion: LUMIFLON FE4500, solid portion: 52% by weight, average particle diameter: 136 nm, minimum film-forming temperature (MFT): 28° C., manufactured by ASAHI GLASS CO., LTD.)

(Acrylic silicone resin emulsion: Polyzole ROY6312, Solid Portion: 40% by weight, average particle diameter: 171 nm, Minimum Film-forming Temperature (MFT): 20° C., manufactured by SHOWA HIGHPOLYMER CO., LTD.)

KF-642: Polyether modified silicone compound (component 100% by weight, manufactured by Shin-Etsu Chemical Co., Ltd.)

SOFTANOL EP-7025: polyoxyalkylene alkyl ether (component 100% by weight, manufactured by NIPPON SHOKUBAI CO., LTD.)

Proxel GXL:

Mildew-proofing agent mainly composed of 1,2-benzisothiazolin-3-one (component: 20% by weight, containing dipropylene glycol, manufactured by Avecia)

KM-72F, self-emulsification type silicone defoaming agent (component: 100% by weight, manufactured by Shin-Etsu Silicone Co., Ltd.)

Preparation Example 27

Preparation of Ink 2 for Inkjet Recording

Ink 2 for inkjet recording is prepared in the same manner as in Preparation Example 26 except that the ink material composition in the ink 1 for inkjet recording is replaced with the ink material composition shown in Table 3.

Preparation Example 28

Preparation of Ink 3 for Inkjet Recording

Ink 3 for inkjet recording is prepared in the same manner as in Preparation Example 26 except that the ink material composition in the ink 1 for inkjet recording is replaced with the ink material composition shown in Table 3.

Preparation Example 29

Preparation of Ink 4 for Inkjet Recording

Ink 4 for inkjet recording is prepared in the same manner as in Preparation Example 26 except that the ink material composition in the ink 1 for inkjet recording is replaced with the ink material composition shown in Table 3.

Preparation Example 30

Preparation of Ink 5 for Inkjet Recording

Ink 5 for inkjet recording is prepared in the same manner as in Preparation Example 26 except that the ink material composition in the ink 1 for inkjet recording is replaced with the ink material composition shown in Table 3.

Preparation Example 31

Preparation of Ink 6 for Inkjet Recording

Ink 6 for inkjet recording is prepared in the same manner as in Preparation Example 26 except that the ink material composition in the ink 1 for inkjet recording is replaced with the ink material composition shown in Table 3.

Preparation Example 32

Preparation of Ink 7 for Inkjet Recording

Ink 7 for inkjet recording is prepared in the same manner as in Preparation Example 26 except that the ink material composition in the ink 1 for inkjet recording is replaced with the ink material composition shown in Table 3.

Preparation Example 33

Preparation of Ink 8 for Inkjet Recording

Ink 8 for inkjet recording is prepared in the same manner as in Preparation Example 26 except that the ink material composition in the ink 1 for inkjet recording is replaced with the ink material composition shown in Table 3.

Inkjet Recording

Inkjet recording is conducted using the devices V to VIII as shown in FIGS. 14 to 17.

Example 1

Application of Process Liquid

Manufacture an applicator described below as the processing fluid applicator and conduct experiments of Examples and Comparative Examples by using the inkjet recording device shown in FIGS. 14 to 17 connected with the applicator.

The applicator uses a roller formed by coating chloroprene rubber having a thickness of 3 mm with a rubber hardness of 50 degree to a plating-treated iron material having a diameter of 22 mm as the application roller and a roller made of SUS 304 having a diameter of 12 mm as the counter roller.

The length of the rollers in the longitudinal direction is 300 mm.

The processing fluid tank is arranged with a gap between the bottom of the application roller and the base of the tank of 2 mm.

The application roller and the counter roller are arranged to be able to arbitrarily adjust the pressure between the rollers.

The driving motor and the application roller are linked with gears.

It is possible to drive the application roller at an arbitrary rotation speed. The processing fluid is applied to the recording medium when the recording medium is introduced between the application roller and the counter roller.

The application amount of the processing fluid is controlled by adjusting the transfer speed and the pressure between the application rollers and the counter roller.

Image Forming

Form images using the inkjet recording device specified in Table 4.

The conditions for the device are as follows.

In an environment of a temperature from 22° C. to 24° C. and a relative humidity of from 45% RH to 55% RH, impart the processing fluid to the recording medium at a transfer speed of 500 m/s uniformly by the application roller with an arbitrary amount. Arrange the recording heads with an inclination angle θ to have a definition of 600 dpi (Q=42.33 um) and discharge the ink droplet with a frequency of 11.81 kHz with a discharging volume of 9.5 pL. Change the driving waveform of the recording head to form images having a definition of 600 dpi×600 dpi with an ink attachment amount of 5.61 g/m$^2$.

The arrangement of the devices is that the distance between the first processing fluid applicator 2 and the second processing fluid applicator 3 is 50 cm, the distance between the second processing fluid applicator 3 and the first nozzle of the recording head 20 is 50 cm.

The transfer roller 13 controls the transfer speed of the recording medium 10 from the first processing fluid applicator 2 to the second processing fluid applicator 3 to arbitrarily control the time between when the processing fluid is applied at the first processing fluid applicator 2 and when the processing fluid is applied at the second processing fluid applicator 3.

Recording Medium

Details of the recording media for use in Examples and Comparative Examples are described below

* My Paper (quality paper): manufactured by Ricoh Co., Ltd.; Basis weight: 69.6 g/m$^2$; Sizing test: 23.2 seconds; Air permeability: 21 seconds;

As illustrated in Table 4, using the image forming apparatus illustrated in FIG. 14, apply Process Liquid 1 of Preparation Example 1 to either or both sides of the recording medium in an amount of 1.60 g/cm$^2$ and discharge Ink 1 to Ink 4 prepared in Preparation Examples in an amount of 5.61 g/cm$^2$ to form images for evaluation.

TABLE 4

| | Applicator and Recording device | Process liquid Kind of processing fluid | Process liquid Application amount (g/cm$^2$) | Elapsed time between applications of processing fluid | Ink Kind of ink | Ink Application amount (g/cm$^2$) |
|---|---|---|---|---|---|---|
| Comparative Example 1 | VIII | 1 | 1.60 | — | 1-4 | 5.61 |
| Comparative Example 2 | VIII | 2 | 1.60 | — | 1-4 | 5.61 |
| Comparative Example 3 | VIII | 3 | 1.60 | — | 1-4 | 5.61 |
| Comparative Example 4 | VII | 1 | 1.60 | — | 1-4 | 5.61 |
| Comparative Example 5 | VII | 2 | 1.60 | — | 1-4 | 5.61 |
| Comparative Example 6 | VII | 3 | 1.60 | — | 1-4 | 5.61 |
| Example 1 | VI | 1 | 1.60 | 0.6 | 1-4 | 5.61 |
| Example 2 | VI | 2 | 1.60 | 0.6 | 1-4 | 5.61 |
| Example 3 | VI | 3 | 1.60 | 0.6 | 1-4 | 5.61 |
| Example 4 | V | 1 | 1.60 | 0.6 | 1-4 | 5.61 |
| Example 5 | V | 2 | 1.60 | 0.6 | 1-4 | 5.61 |
| Example 6 | V | 3 | 1.60 | 0.6 | 1-4 | 5.61 |
| Example 7 | V | 1 | 1.60 | 0.2 | 1-4 | 5.61 |
| Example 8 | V | 1 | 1.60 | 0.4 | 1-4 | 5.61 |
| Example 9 | V | 1 | 1.60 | 0.8 | 1-4 | 5.61 |
| Example 10 | V | 1 | 1.60 | 1 | 1-4 | 5.61 |
| Example 11 | V | 2 | 1.60 | 0.2 | 1-4 | 5.61 |
| Example 12 | V | 2 | 1.60 | 0.4 | 1-4 | 5.61 |
| Example 13 | V | 2 | 1.60 | 0.8 | 1-4 | 5.61 |
| Example 14 | V | 2 | 1.60 | 1 | 1-4 | 5.61 |
| Example 15 | V | 1 | 0.64 | 0.6 | 1-4 | 5.61 |
| Example 16 | V | 1 | 0.96 | 0.6 | 1-4 | 5.61 |
| Example 17 | V | 1 | 2.41 | 0.6 | 1-4 | 5.61 |
| Example 18 | V | 1 | 2.73 | 0.6 | 1-4 | 5.61 |
| Example 19 | V | 2 | 0.64 | 0.6 | 1-4 | 5.61 |
| Example 20 | V | 2 | 0.96 | 0.6 | 1-4 | 5.61 |
| Example 21 | V | 2 | 2.41 | 0.6 | 1-4 | 5.61 |
| Example 22 | V | 2 | 2.73 | 0.6 | 1-4 | 5.61 |
| Example 23 | V | 1 | 1.60 | 0.6 | 5-8 | 5.61 |
| Example 24 | V | 2 | 1.60 | 0.6 | 5-8 | 5.61 |
| Example 25 | V | 3 | 1.60 | 0.6 | 5-8 | 5.61 |
| Example 26 | V | 4 | 1.60 | 0.6 | 1-4 | 5.61 |
| Example 27 | V | 5 | 1.60 | 0.6 | 1-4 | 5.61 |
| Example 28 | V | 6 | 1.60 | 0.6 | 1-4 | 5.61 |
| Example 29 | V | 7 | 1.60 | 0.6 | 1-4 | 5.61 |
| Example 30 | V | 8 | 1.60 | 0.6 | 1-4 | 5.61 |
| Example 31 | V | 9 | 1.60 | 0.6 | 1-4 | 5.61 |
| Example 32 | V | 10 | 1.60 | 0.6 | 1-4 | 5.61 |
| Example 33 | V | 11 | 1.60 | 0.6 | 1-4 | 5.61 |
| Example 34 | V | 12 | 1.60 | 0.6 | 1-4 | 5.61 |
| Example 35 | V | 13 | 1.60 | 0.6 | 1-4 | 5.61 |

TABLE 4-continued

| | Applicator and Recording device | Process liquid Kind of processing fluid | Process liquid Application amount (g/cm$^2$) | Elapsed time between applications of processing fluid | Ink Kind of ink | Ink Application amount (g/cm$^2$) |
|---|---|---|---|---|---|---|
| Example 36 | V | 14 | 1.60 | 0.6 | 1-4 | 5.61 |
| Example 37 | V | 15 | 1.60 | 0.6 | 1-4 | 5.61 |
| Example 38 | V | 16 | 1.60 | 0.6 | 1-4 | 5.61 |
| Example 39 | V | 17 | 1.60 | 0.6 | 1-4 | 5.61 |
| Example 40 | V | 18 | 1.60 | 0.6 | 1-4 | 5.61 |
| Example 41 | V | 19 | 1.60 | 0.6 | 1-4 | 5.61 |
| Example 42 | V | 20 | 1.60 | 0.6 | 1-4 | 5.61 |

The numbers for the kind of the processing fluid and the kind of the ink correspond to the numbers of the processing fluid and the ink specified in the Preparation Examples of Process Liquid and Preparation Examples of Ink.

Example 2

Form images for evaluation in the same manner as in Example 1 except that, using the image forming apparatus specified in Table 4, apply the processing fluid specified in Table 4 to both sides of the recording medium with a ratio specified in Table 4 with the elapsed time shown in Table 4 after the time specified in Table 4, discharge the ink specified in Table 4 with an amount specified in Table 4.

Example 3

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 4

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 5

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 6

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 7

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 8

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 9

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 10

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 11

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 12

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 13

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 14

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 15

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 16

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 17

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 18

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 19

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 20

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 21

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 22

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 23

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 24

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 25

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 26

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 27

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 28

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 29

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 30

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 31

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 32

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 33

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 34

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 35

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 36

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 37

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 38

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 39

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 40

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 41

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Example 42

Form images for evaluation in the same manner as in Example 1 except that, using the image forming apparatus specified in Table 4, apply the processing fluid specified in Table 4 to both sides of the recording medium with a ratio specified in Table 4 with the elapsed time specified in Table 4, discharge the ink specified in Table 4 with an amount specified in Table 4.

Comparative Example 1

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Comparative Example 2

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Comparative Example 3

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Comparative Example 4

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Comparative Example 5

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Comparative Example 6

Form images for evaluation in the same manner as in Example 1 except that, using the image forming apparatus specified in Table 4, apply the processing fluid specified in Table 4 to one side of the recording medium with a ratio specified in Table 4 and discharge the ink specified in Table 4 with an amount specified in Table 4.

Evaluation of Image Density

Form images using the inkjet recording device shown in Table 5 under the same conditions as for the image forming method.

Discharge the ink separately (color by color) according to the image pattern at a square of 30 mm×30 mm on the printing side and measure the color of the image by X-Rite 938 to determine the level according to the following evaluation criteria.

Evaluation Criteria

E (Excellent):
Black: 1.3 or greater
Yellow: 0.85 or greater
Magenta: 1.05 or greater
Cyan: 1.1 or greater G (Good):
Black: 1.2 to less than 1.3
Yellow: 0.8 to less than 0.85
Magenta: 1.0 to less than 1.05
Cyan: 1.0 to less than 1.1

F (Fair):
Black: 1.15 to less than 1.2
Yellow: 0.75 to less than 0.8
Magenta: 0.95 to less than 1.0
Cyan: 0.95 to less than 1.0

B (Bad):
Black: less than 1.15
Yellow: less than 0.75
Magenta: less than 0.95
Cyan: less than 0.95

Evaluation on Curling

Form images using the inkjet recording device shown in Table 5 under the same conditions as for the image forming method.

Form a solid image on the entire of the recording medium except for portions between all the four sides and 15 mm therefrom, place the recording medium transferred to the discharging unit on a flat surface with the printed face down manually within five seconds of printing, and measure the height of the four corners of the recording medium from the flat surface to determine the level according to the following evaluation criteria.

Evaluation Criteria

E (Excellent): less than 20 mm
G (Good): 20 mm to less than 30 mm
F (Fair): 30 mm to less than 40 mm
B (Bad): 40 HIM or greater Evaluation on Offset As in the same manner as for the evaluation on the image density, discharge the ink separately to a square of 40 mm×200 mm on the printing side of the recording medium, roll a cylindrical polyethylene roller having a diameter of 40 mm on the recording medium while pressing it under a load of 5 N within five seconds of printing, and measure the color of the portion of the recording medium to which the ink is re-transferred from the cylindrical roller by X-Rite 938 to determine the level according to the following evaluation criteria.

Evaluation Criteria

E (Excellent): less than 0.1

G (Good): 0.1 to less than 0.15

F (Fair): 0.15 to less than 0.3

B (Bad): 0.3 or higher

The results are shown in Table 5. The evaluations are made for each color according to the respective evaluation criteria.

The results of the image quality represent the most evaluations.

When the most evaluations are two or more, the better evaluations are selected.

TABLE 5

| | Image density | Curling | Offset |
|---|---|---|---|
| Comparative Example 1 | E | B | G |
| Comparative Example 2 | E | B | G |
| Comparative Example 3 | F | B | G |
| Comparative Example 4 | F | E | G |
| Comparative Example 5 | F | G | G |
| Comparative Example 6 | F | E | G |
| Example 1 | E | G | G |
| Example 2 | E | F | G |
| Example 3 | F | G | G |
| Example 4 | E | E | G |
| Example 5 | E | G | G |
| Example 6 | F | E | G |
| Example 7 | E | F | G |
| Example 8 | E | G | G |
| Example 9 | E | E | G |
| Example 10 | E | E | G |
| Example 11 | E | F | G |
| Example 12 | E | F | G |
| Example 13 | E | G | G |
| Example 14 | E | G | G |
| Example 15 | G | F | G |
| Example 16 | E | G | G |
| Example 17 | E | E | G |
| Example 18 | E | E | F |
| Example 19 | G | F | G |
| Example 20 | E | F | G |
| Example 21 | E | G | G |
| Example 22 | E | G | F |
| Example 23 | E | E | G |
| Example 24 | E | G | G |
| Example 25 | F | E | G |
| Example 26 | E | E | G |
| Example 27 | E | E | G |
| Example 28 | E | E | G |
| Example 29 | E | E | G |
| Example 30 | E | E | G |
| Example 31 | E | F | G |
| Example 32 | E | F | G |
| Example 33 | E | G | G |
| Example 34 | E | G | G |
| Example 35 | E | F | G |
| Example 36 | E | F | G |
| Example 37 | E | E | G |
| Example 38 | E | E | G |
| Example 39 | F | E | G |
| Example 40 | F | F | G |
| Example 41 | F | G | G |
| Example 42 | F | F | G |

As seen in the results, it is found that when images are formed immediately after application of the processing fluid of Comparative Examples 1 to 3 to the image forming side, the results are bad about curling.

It is found that in the case in which the processing fluid of Comparative Examples 4 to 6 is applied only to the side on which no image is formed, curling is significantly reduced but the image density is not improved.

In the case of Examples 1 to 3 in which the processing fluid is firstly applied to the side of the recording medium reverse to the side on which an image is not firstly formed and then the processing fluid is applied to the side on which an image is firstly formed before image forming, curling is reduced but its reduction impact slightly inferior to Comparative Examples 4 to 6.

It is also found that the processing fluid containing the agglomerating agent improves the image quality.

In the case of Examples 4 to 6 in which the processing fluid is firstly applied to the side of the recording medium on which an image is firstly formed and then the processing fluid is applied to the side reverse to the side on which an image is firstly formed, it is found that curling is reduced equally to Comparative Examples 4 to 6 and the processing fluid containing the agglomerating agent improves the image density.

It is found that curling is reduced and the image quality is improved by forming images after applying the processing fluid to both sides of the recording medium.

As a result of the investigation about the time (hereinafter referred to as the application time) between when the processing fluid is applied to the side on which an image is firstly formed at the first processing fluid applicator and when the processing fluid is applied to the side on which an image is secondarily formed at the second processing fluid applicator in Examples 7 to 14, it is found that when the application time is 0.6 seconds or longer, the reduction effect on curling is significant.

As a result of the investigation about the application amount of the processing fluid in Examples 15 to 22, it is found that curling is significantly improved when the amount is 0.96 g/cm$^2$ or higher and the offset (drying property) resistance ameliorates when the amount is 2.41 g/cm$^2$ or less.

As a result of the investigation about the kinds of the ink by changing the combination of the ink in Examples 23 to 25 from that in Examples 1 to 22, the same results are obtained. Therefore, it is found that the kind of the ink has little impact in the present disclosure.

As a result of the investigation about the kinds of the processing fluid by changing the kinds of the processing fluid in Examples 26 to 42 from those in Examples 1 to 22, the curling reduction is found to be excellent when the hydrosoluble organic solvent in the processing fluid is 30% by weight or more and the ratio of the hydrosoluble organic solvent B having a small equilibrium moisture is 80% by weight or more.

What is claimed is:

1. An image forming method comprising:

applying a processing fluid for inkjet recording to both sides of a recording medium, and the applying the processing fluid includes:

first applying the processing fluid to a side of the recording medium on which an image is formed, and thereafter applying the processing fluid to a reverse side of the recording medium, and said thereafter applying the processing fluid to the reverse side of the recording medium starts 0.6 seconds or more after a start of said first applying the processing fluid to the side of the recording medium on which the image is formed; and after applying the processing fluid, discharging ink onto at least one side of the recording medium to form an image thereon, wherein the processing fluid for inkjet recording comprises water and a hydrosoluble organic solvent.

2. The image forming method according to claim 1, wherein an attachment amount of the processing fluid per side in the applying the processing fluid is from 0.96 $g/m^2$ to 2.5 $g/m^2$.

3. The image forming method according to claim 1, wherein a content of the hydrosoluble organic solvent is 30% by weight or more based on a total amount of the processing fluid.

4. The image forming method according to claim 1, wherein the hydrosoluble organic solvent comprises two hydrosoluble organic solvents A and B, wherein hydrosoluble organic solvent A has an equilibrium moisture less than 30% by weight at a temperature of 23° C. and a relative humidity of 80%, and comprises 80% of the hydrosoluble organic solvent by weight.

5. The image forming method according to claim 1, wherein the processing fluid comprises a hydrosoluble agglomerating agent, a surface active agent, a hydrosoluble organic solvent, and water.

6. An image forming method comprising:

applying a processing fluid for inkjet recording to both sides of a recording medium, and the applying the processing fluid includes:

first applying the processing fluid to a reverse side of the recording medium, and thereafter applying the processing fluid to a side of the recording medium on which an image is formed; and after applying the processing fluid, discharging ink onto at least one side of the recording medium to form an image thereon, wherein the processing fluid for inkjet recording comprises water and a hydrosoluble organic solvent.

7. The image forming method according to claim 6, wherein said thereafter applying the processing fluid to the reverse side of the recording medium starts 0.6 seconds or more after a start of said first applying the processing fluid to the side of the recording medium on which the image is formed.

8. The image forming method according to claim 6, wherein an attachment amount of the processing fluid per side in the applying the processing fluid is from 0.96 $g/m^2$ to 2.5 $g/m^2$.

9. The image forming method according to claim 6, wherein a content of the hydrosoluble organic solvent is 30% by weight or more based on a total amount of the processing fluid.

10. The image forming method according to claim 6, wherein the hydrosoluble organic solvent comprises two hydrosoluble organic solvents A and B, wherein hydrosoluble organic solvent A has an equilibrium moisture less than 30% by weight at a temperature of 23° C. and a relative humidity of 80%, and comprises 80% of the hydrosoluble organic solvent by weight.

11. The image forming method according to claim 6, wherein the processing fluid comprises a hydrosoluble agglomerating agent, a surface active agent, a hydrosoluble organic solvent, and water.

12. An inkjet recording device configured to:

apply a processing fluid for inkjet recording to both sides of a recording medium, including:

first apply the processing fluid to a side of the recording medium on which an image is formed, and thereafter apply the processing fluid to a reverse side of the recording medium, and start the thereafter apply of the processing fluid to the reverse side of the recording medium 0.6 seconds or more after a start of the first apply of the processing fluid to the side of the recording medium on which the image is formed; and after applying the processing fluid, discharge ink onto at least one side of the recording medium to form an image thereon, wherein the processing fluid for inkjet recording comprises water and a hydrosoluble organic solvent.

* * * * *